US008091479B1

(12) United States Patent
Jakaboski et al.

(10) Patent No.: US 8,091,479 B1
(45) Date of Patent: Jan. 10, 2012

(54) FLUID BLADE DISABLEMENT TOOL

(75) Inventors: Juan-Carlos Jakaboski, Albuquerque, NM (US); Chance G. Hughs, Albuquerque, NM (US); Steven N. Todd, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 209 days.

(21) Appl. No.: 12/486,888

(22) Filed: Jun. 18, 2009

(51) Int. Cl.
*F42B 3/00* (2006.01)
*F42D 3/00* (2006.01)

(52) U.S. Cl. ..... 102/306; 102/305; 102/331; 86/50

(58) Field of Classification Search ..... 102/475, 102/476, 305, 306, 307, 331; 86/50
See application file for complete search history.

(56) References Cited

U.S. PATENT DOCUMENTS

| | | | | |
|---|---|---|---|---|
| 3,103,882 | A * | 9/1963 | Gilliland | 102/309 |
| 3,188,955 | A * | 6/1965 | Brown | 102/306 |
| 3,190,219 | A * | 6/1965 | Venghiattis | 102/306 |
| 4,905,601 | A * | 3/1990 | Gabriel et al. | 102/307 |
| 4,955,939 | A * | 9/1990 | Petrousky et al. | 102/476 |
| 5,136,920 | A | 8/1992 | Breed et al. | |
| 5,170,004 | A * | 12/1992 | Garrison | 89/1.14 |
| 6,269,725 | B1 | 8/2001 | Cherry | |
| 6,408,731 | B1 | 6/2002 | Elsener | |
| 6,584,908 | B2 | 7/2003 | Alford | |

FOREIGN PATENT DOCUMENTS

| | | |
|---|---|---|
| GB | 2292445 | 2/1996 |

* cited by examiner

*Primary Examiner* — James Bergin
(74) *Attorney, Agent, or Firm* — Carol I Ashby

(57) ABSTRACT

A fluid blade disablement (FBD) tool that forms both a focused fluid projectile that resembles a blade, which can provide precision penetration of a barrier wall, and a broad fluid projectile that functions substantially like a hammer, which can produce general disruption of structures behind the barrier wall. Embodiments of the FBD tool comprise a container capable of holding fluid, an explosive assembly which is positioned within the container and which comprises an explosive holder and explosive, and a means for detonating. The container has a concavity on the side adjacent to the exposed surface of the explosive. The position of the concavity relative to the explosive and its construction of materials with thicknesses that facilitate inversion and/or rupture of the concavity wall enable the formation of a sharp and coherent blade of fluid advancing ahead of the detonation gases.

22 Claims, 22 Drawing Sheets

20 μsec

Prior Art

60 μsec

Prior Art

80 μsec

Prior Art

100 μsec

Prior Art

FLUID BLADE DISABLEMENT TOOL

The United States Government has rights in this invention pursuant to Department of Energy Contract No. DE-AC04-94AL85000 with Sandia Corporation.

BACKGROUND OF THE INVENTION

This invention relates to a tool for dynamically disabling an explosive device, such as an improvised explosive device (IED) or a weapon of mass destruction (WMD). Emergency response personnel and bomb technicians often use energetic tools to disable such devices. One class of tools for such applications uses high explosive to accelerate water contained in a plastic container that impacts and disrupts an IED over a broad area. Another class of tools uses high explosive in the shape of a chevron to accelerate a focused blade of water to disrupt the IED. Prior art devices of both types generate high-speed plastic or fluid fragments that can impact the target IED prior to the impact of the main water projectile, thereby creating localized areas of high pressure on the target surface. This can produce unintended detonation of the IED.

Cherry (U.S. Pat. No. 6,269,725) concerns an apparatus and method for disarming improvised bombs. The apparatus comprises a fluid-filled bottle or container made of plastic or another soft material which contains a fixed or adjustable charge, preferably sheet explosive. The charge is fired centrally at its apex and can be adjusted to propel a fluid projectile that is broad or narrow, depending upon how it is set up. Common materials such as plastic water bottles or larger containers can be used, with the sheet explosive or other explosive material configured in a general chevron-shape to target the projectile toward the target.

Alford (U.S. Pat. No. 6,584,908) concerns a device for the disruption of explosive objects. The device of this patent for generating a liquid jet comprises an enclosure containing a plurality of formers, each defining a cavity and each supporting an explosive charge, and a filler material adjacent to the charge within the cavity, the filler material being a liquid, a gel, or a nonmetallic solid that will liquefy upon detonation. A single-former device is described in a UK application of Alford (GB 2292445).

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

This invention comprises a fluid blade disablement (FBD) tool that forms both a focused fluid projectile that resembles a blade, which can provide precision penetration of a barrier wall, and a broad fluid projectile that functions substantially like a hammer, which can produce general disruption of structures behind the barrier wall. One example of an application of the FBD tool is the penetration of an IED container wall and disruption of the explosive assembly within the IED to make it inoperable. Embodiments of the FBD tool comprise a container capable of holding fluid, an explosive assembly which is positioned within the container and which comprises an explosive holder and explosive, and a detonator. The container has a concavity on the side facing a side of the explosive not blocked by the holder, such as the front side of the explosive. The position of the concavity relative to the explosive and its construction of materials with thicknesses that facilitate inversion and/or rupture of the concavity wall enable the formation of a coherent projectile of fluid advancing ahead of the detonation gases. With a readily deformable material, such as, for example, a metal, the at least partially inverted former bottom of the concavity wall can be separated fro the rest of the concavity wall and be carried forward on the tip of the advancing fluid blade, thereby providing a metal-tipped fluid projectile. This projectile has a blade-like structure, the detailed geometry of which being determined by the shape of the concavity. This fluid blade can quickly and effectively cut a hole through a barrier wall and begin disruption of structures and/or materials that may be behind the barrier wall. Following the impact of the fluid blade, more of the fluid that was in the container is propelled by expanding detonation gases against the barrier wall and through the opening created by the fluid blade. This additional fluid further disrupts the structures and/or materials. This secondarily impacting fluid body functions substantially like a fluid hammer in its disruption activity. The FBD tool employs a relatively small quantity of explosive to generate a fluid blade cable of penetrating a steel wall. For example, a few tens of grams of one of the explosives commonly found in a first-responder's inventory is used in some embodiments that can penetrate ¼"-thick steel.

Figure 1:
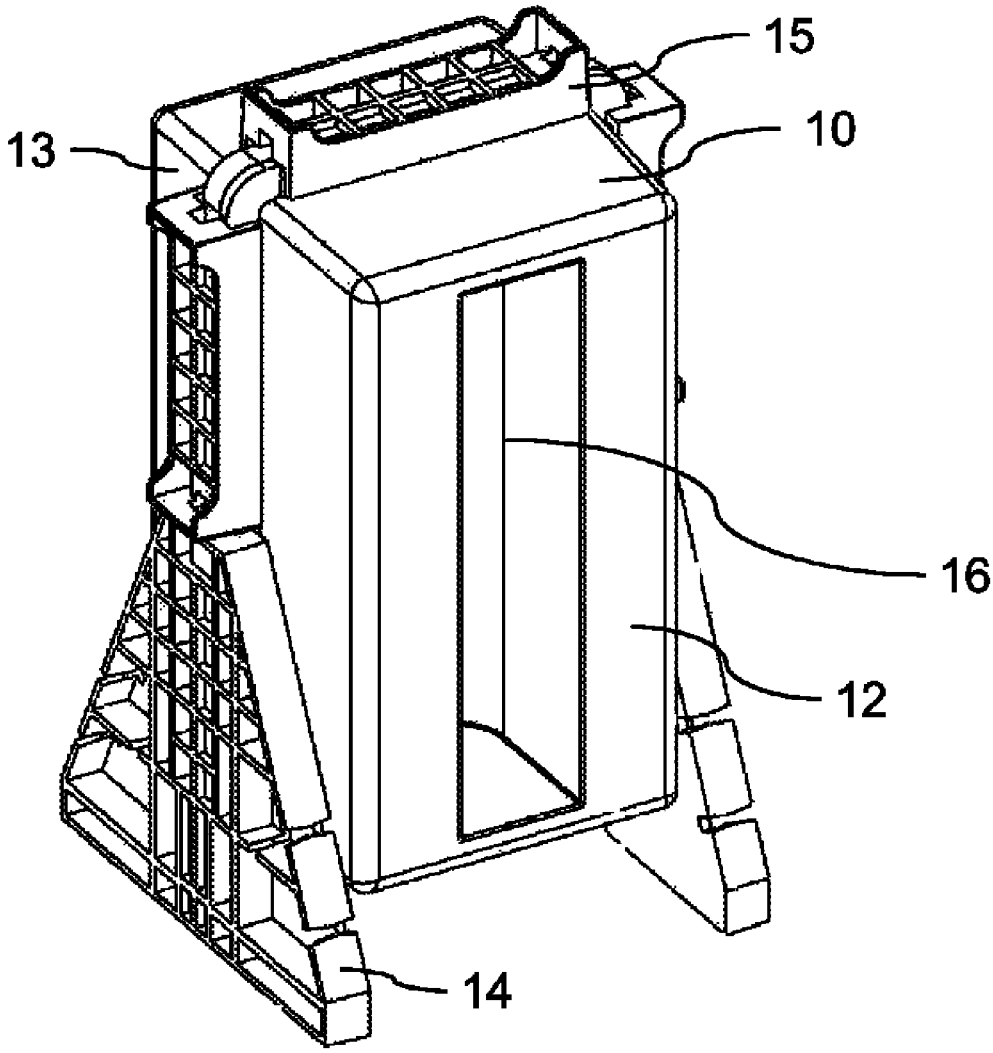
FIG. 1 presents an embodiment wherein the container is substantially closed.
Figure 2:
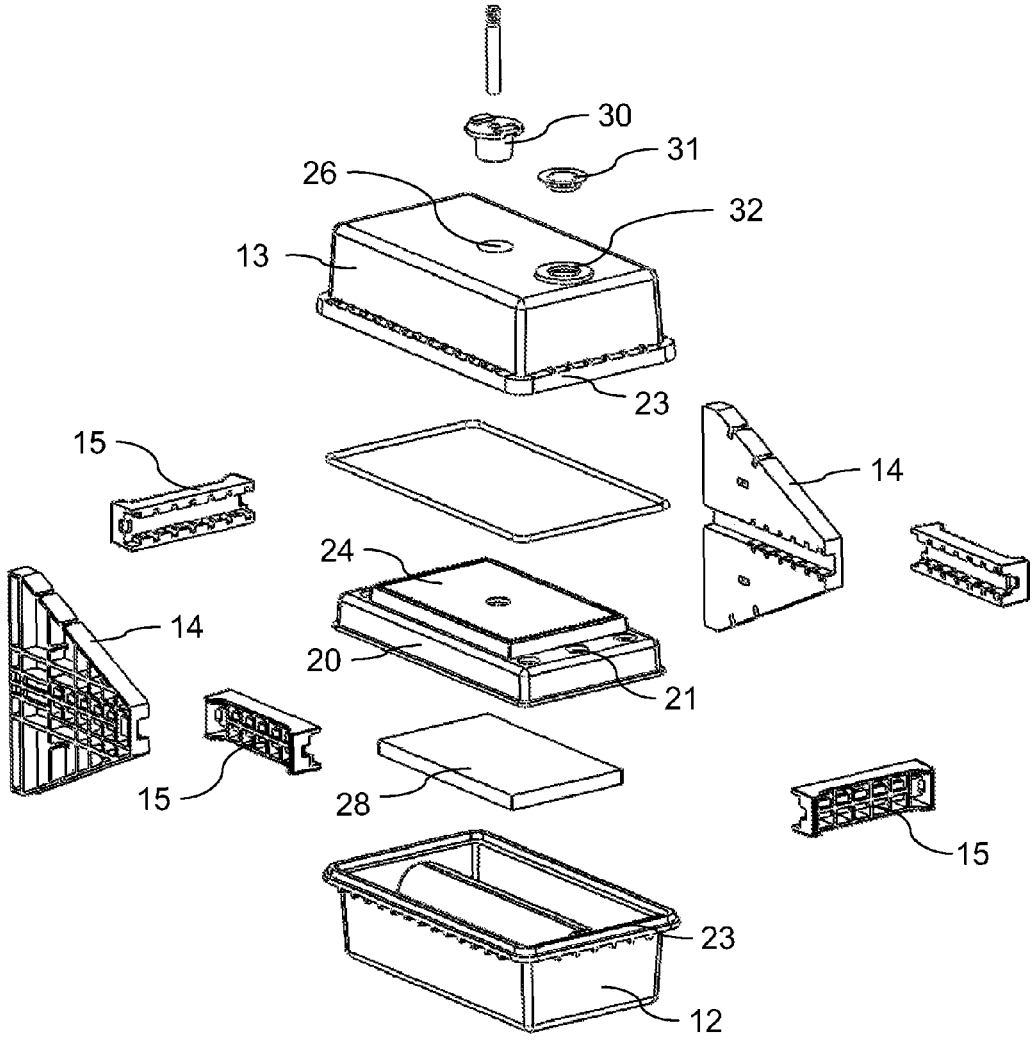
FIG. 2 presents a view of components comprising the embodiment illustrated in FIG. 1.
Figure 3:
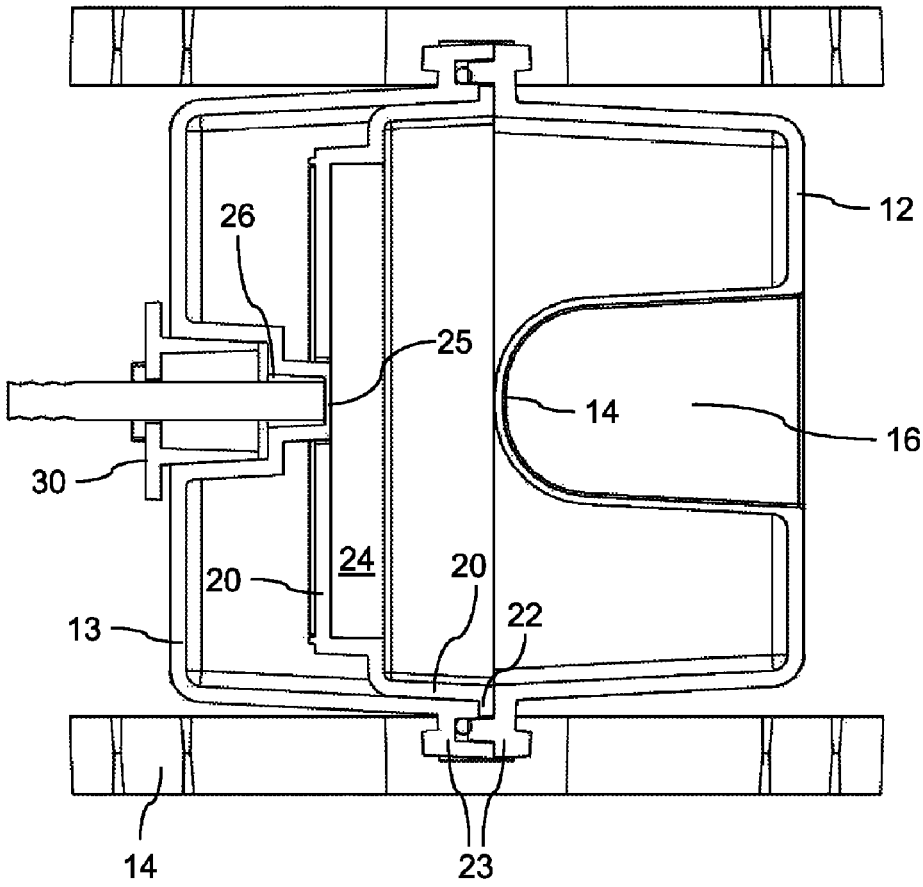
FIG. 3 presents a cross-sectional view through the concavity and detonator of the embodiment illustrated in FIG. 1.

FIG. 1 illustrates an embodiment wherein the container is a substantially closed structure that is to be filled with fluid before use to generate the fluid blade. This embodiment can be filled with fluid and sealed for use in horizontal, vertical, diagonal, and other configurations as desired. FIG. 2 presents an exploded view of the embodiment in FIG. 1. FIG. 3 presents a cross-sectional view of the embodiment of FIG. 1 with the cross-section passing through the detonator well. In this embodiment, the container 10 comprises two sections 12 and 13. The front section 12 comprises a front container side in which a concavity 16 is located. In this embodiment, the concavity 16 is a trough with a U-shaped cross-sectional profile and with substantially flat trough ends. Other trough shapes with different cross-sectional profiles and with different trough end geometries can also be used. Mating means 23 comprising a flange are located on the front and back segments and mate to provide a substantially fluid-tight seal. In the illustrated embodiment of FIGS. 2 and 3, the flange facing comprises a tongue-and-groove joint with a trapped O-ring to improve fluid-tightness. Alternative flange facings may be employed in various embodiments, including but not restricted to a flat face, a raised face, a ring joint, a male-and-female joint, a tongue-and-groove joint, and other flange facings capable of achieving a substantially fluid-tight seal. In the illustrated embodiment, clamps 15 hold the flange facings together. In embodiments, such as those illustrated in FIGS. 1-3, legs 14 can be affixed to the flange facings to support the container in a particular orientation (horizontal or vertical) and also serve as part of the clamping system. An explosive holder 20 is situated within the container. The explosive holder in the illustrated embodiment comprises a flange edge 22 configured for engagement with the front and/or back sections. Other modes of positioning the explosive holder within the container may also be used. Examples include but are not restricted to mating at least one post with at least one holding structure. The side and cross-sectional shape of such posts can be varied widely and can include, for example, a circle, an oval, a parallelogram, a triangle, a polygon, and a curved shape. Such posts can be slotted or grooved with key seats to permit insertion of a parallel or tapered key. It is intended to include in the scope of this invention any other suitable way of mounting the explosive holder within the container that might be devised by one of skill in mechanical arts. In the embodiment illustrated in FIGS. 1-3, engagement of the flange edge 22 with the mating means 23 serves to hold the explosive holder in the proper position within the container. Apertures 21 in the explosive holder 20 allow fluid communication between different sections of the container. In the illustrated embodiment, holes in the explosive holder provide the fluid communication, but other structures that permit fluid communication between front and back sections of the container can also be used in variations of this and other embodiments. Such alternative structures are well known in the art, and it is intended that such structures be included within the scope of this invention. Fluid can be introduced into the container through a fluid port structure comprising a fluid port 32. In the illustrated embodiment, the fluid port is located on the back side of the container and can be sealed with a plug 31. The location and type of fluid port can be varied widely in different embodiments, as is well known in the mechanical arts for fluid containment. The port could alternatively be located, for example, on the front, top, bottom, or sides of the container. The port structure can be any of a wide range of structures that will admit fluid into the container, as would be clear to one skilled in fluid container art. A plurality of ports can also be used. With a plurality of ports, fluid communication between different sections of the container may be optional. For example, direct fluid communication between the front and back section of the container may not be needed if ports are provided on each side for the introduction of fluid. In embodiments where there is not fluid communication between all sections of the container, material other than the type of fluid that is to be made into the fluid blade can be used on some portion of the back top, bottom, and side regions. Such embodiments provide variable and/or controllable tamping to improve the fraction of total explosive force directed into blade formation; see, for one example, FIG. 8. This tamping material and/or structure need not be a fluid. The tamping material can be fluid, solid, or a combination.

In the embodiments of FIGS. 1-3, plastic explosive 28 is positioned within an explosive-receiving cavity section 24 of the explosive holder 20. The thickness of the plastic explosive 28 can be varied and selected in accordance with the desired force of the fluid blade that is to be generated upon detonation. One convenient but not exclusive way to vary the thickness of plastic explosive is to employ a stack of sheets of plastic explosive, where varying the number of sheets varies the amount of explosive. Alternatively, the desired amount of bulk plastic explosive can be pressed into the explosive receiving cavity provided sufficient control and/or uniformity of packing into the receiving cavity is achieved to obtain the detonation gas generation profile that is desired. In other embodiments, a containerized liquid explosive can be positioned using a suitable explosive holder. A wide range of explosives can be used in various embodiments of this invention. Some of the explosives that may be employed include but are not restricted to trinitrobenzene (TNB), trinitrotoluene (TNT), trinitrobenzoic acid (TNBA), trinitroaniline (TNA), tetryl, ethyl tetryl, picric acid, ammonium picrate, methyl picrate, ethyl picrate, picryl chloride, trinitroxylene (TNX), trinitrocresol, styphnic acid, lead styphnate, triaminotrinitrobenzene (TATB), hexanitroazobenzene (HNAB), hexanitrostilbene (HNS), tetranitrodibenzotetrazapentalene, tetranitrocarbazole (TNC), tetranitrodibenzotetrazapentalene (TACOT), methyl nitrate, nitroglycol, nitroglycerine, erythritoltetranitrate, mannitol hexanitrate, pentaerythritol tetranitrate (PETN), pentaerythritol trinitrate (PETRIN), ethylenedinitramine (EDNA), nitroguanidine (NQ), nitro urea, cyclo-1,3,5-trimethylene-2,4,6-trinitramine (RDX), cyclotetramethylenetetranitramine (HMX), tetranitroglycolurile, mercury fulminate, lead azide, silver azide, and ammonium nitrate, combinations thereof, combinations thereof with inert materials, nitromethane, and a binary liquid explosive. Examples of binary liquid explosives include but are not restricted to ammonium nitrate fuel oil (ANFO) and ammonium nitrate/ammonium perchloriate fuel oil combinations. One example is Tannerite comprises ammonium nitrate, ammonium perchlorate, and a sensitizer of aluminum powder, titanium powder, and zirconium hydroxide. Numerous combinations of ammonium nitrate and ammonium perchlorate are sold by different manufacturers and are suitable for embodiments of this invention. Suitable examples of "fuel oil" include gasoline, diesel, nitromethane, and other organic solvents with similar properties. Explosives can be blended with other explosives and/or inert materials, for example, as pressings, castings, plastic bonded forms, plastic machined forms, putties, rubberized forms, extrudable forms, binary forms, blasting agents, slurries, gels, and dynamites. Other explosives known to those of skill in the explosive art can also be used.

The concavity wall 14 at the bottom of the trough 16 is sufficiently thin to allow at least partial inversion of the curvature of the bottom wall 14 under the pressure generated by detonation of the explosive 28. The upper limit on this thickness is determined by the type of material and the amount of explosive. The location of the concavity near the explosive and the concavity wall thickness at the concavity bottom contribute to the bottom of the concavity being a mechanically weak region of the container that responds strongly when experiencing pressure from the expanding gases shortly after detonation. After detonation, a thin plastic wall will at least partially invert, stretch out into a blade, and tear apart. If the plastic is a material with physical properties like polycarbonate, a wall of thickness greater than about 0.1" will resist inversion; this can deleteriously affect the formation of a well-defined and predictable fluid blade. In one version of the embodiment illustrated in FIG. 1, the concavity bottom wall was 0.05" thick and the other walls were 0.1" thick. When made of polycarbonate, these parts fail and tear upon detonation of the device. The details of the mode of failure of the portions of the container not forming the concavity in general will not significantly affect performance of the device.

Inversion of curvature need not be complete; structural failure of the bottom without complete inversion in such a way as to allow formation of the nascent blade and advancement of the blade ahead of the detonation gases is also within the scope of this invention. Curved deformation of a flat surface is termed inversion of curvature. The bottom of the trough can be made of the same or different material as the walls of the trough and/or the rest of the container. The material at the bottom of the trough can comprise a material that deforms readily when subjected to pressure. In some embodiments, the bottom of the trough may comprise a metal of a thickness that allows the curvature to be at least partially inverted by the explosive-generated force. In embodiments where the thickness of the explosive 28 is at least approximately half the thickness of the concavity wall 14, concavities comprising plastics with mechanical deformation properties similar to those of polycarbonate and deformable metals will allow blade formation when concavity wall thicknesses are less than approximately 0.5 inches. Greater thickness than 0.5 inches of materials that will flex more under the applied pressure can be used for the concavity bottom provided sufficient flexing to define the nascent blade can occur. Greater wall thicknesses can be used in embodiments with higher explosive charges.

Figure 5:
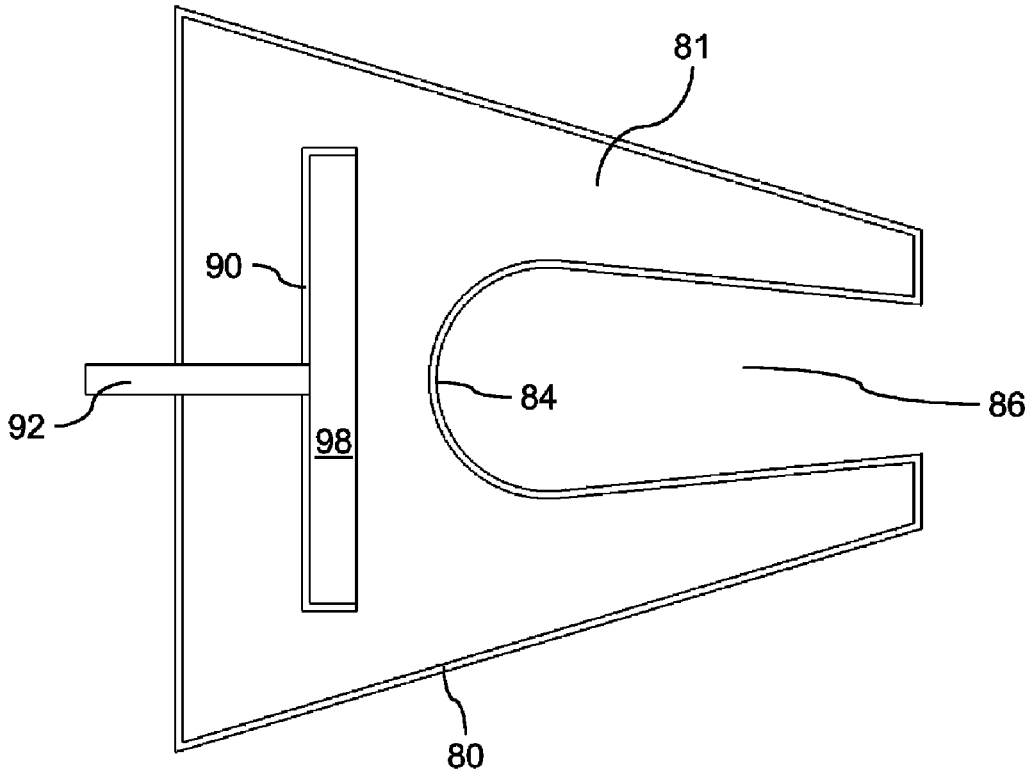
FIG. 5 presents a cross-sectional top view of an embodiment wherein the container is open on top.

A variety of shapes of the concavity bottom and trough ends can be employed in various embodiments. Examples of suitable concavity bottom shapes include but are not restricted to trough bottom shapes that are curved, substantially flat, substantially flat with filleted walls, substantially flat with chamfered walls, wedge shaped, flared, and shaped in other shapes that lend themselves to at least partial inversion of curvature under pressure. Examples of suitable trough end shapes include but are not restricted to substantially flat surfaces, filleted surfaces, chamfered surfaces, curved surfaces and other surfaces that do not substantially impede the inversion of the trough bottom curvature when subjected to the explosive-generated pressure. In some embodiments, at least one of the ends of the concavity is open. One embodiment with an open trough end and an open top of the container is illustrated in FIG. 5.

In the embodiment illustrated in FIG. 3, the explosive holder 20 optionally comprises an explosive-receiving cavity 24 and optionally a thin-walled region 25 adjacent to the detonator well 26 that is substantially opposite the bottom 14 of the trough 16. The thin-walled region facilitates the achievement of a substantially fluid-tight container. In some embodiments, an aperture may be located at the bottom of the detonator well, with a fluid seal being provided by material that is packed into the detonator well, such as, for example, plastic explosive.

A detonating-means holder 30 is inserted into the detonator well 26 to hold the detonating means in the proper position for detonation. A variety of detonating means may be employed in embodiments of this invention; such means are known to those of skill in the explosive art. The detonating means can be an electrical detonator or a percussion detonator. The detonating means can be selected from a wide variety of detonators including but not limited to detonating cord, blasting caps or other non-electric detonators, instantaneous non-electric detonators, short period delay non-electric detonators, long period delay non-electric detonators, instantaneous electric detonators, short period delay electric detonators, long period delay electric detonators, exploding-bridgewire detonators, slapper detonators, pencil detonators, stab initiator detonators, hot wire initiator detonators, any other type of detonator, and direct laser initiation of high explosive. In some embodiments, the detonator well 26 is partially filled with explosive. A detonating cord is inserted into the holder 30 and knotted. Plastic explosive is packed into the open end of the detonating-means holder to obtain good detonating contact with the detonator cord. The holder 30 is inserted into the well to operably contact the detonating cord/explosive with the explosive in the detonator well.

The location of the detonating means and the number of detonating means can be varied in different embodiments. Multiple detonating means can be used to initiate the explosive. Multipoint detonation, initiation along a centerline, and initiation of one side of the explosive can be used in various embodiments. For one embodiment, an explosive assembly employing multipoint initiation comprises a support structure consisting of an inert material, such as, for example, plastic, clay, wood, rubber, and metal. The structure can contain cavities such as wells and/or trenches of suitable dimensions to exceed the critical diameter for sustaining detonation for a given explosive. A detonating means is employed to initiate the explosive packed into the cavities within the support structure. In various embodiments, the support structure for multipoint detonation can communicate the detonation wave from the detonator to two or more points of the main explosive charge or to one or more lines of detonation along the edge or center of the main explosive charge for single- or dual-line initiation. In some embodiments, the support structure can include tracks for explosives that transmit the detonation wave from a single detonator to many points along the surface of the main explosive charge such that the entire surface of the main explosive charge is initiated at substantially the same time, serving as a plane-wave generator. The choice between single-point and multipoint initiation can be guided by considerations of the geometry of the fluid container, concavity, and main explosive charge for a particular embodiment.

In various embodiments, the surface curvature of the explosive can be relatively flat, as in FIG. 2, or the explosive can be curved. Relatively symmetrical placement of the explosive with respect to the concavity facilitates formation of a well-defined blade.

For one embodiment, the concavity dimensions were approximately 1.3 inches wide, approximately 6 inches long, and approximately 2 inches deep. The concavity extends approximately half way into the container. The width of the concavity is approximately one third of the width of the fluid container. The bottom of the concavity was filleted or rounded into an approximately semicircular curvature. The fluid blade formed by this device was approximately ¼ inch wide, approximately 6 inches long, and had a height of approximately 2 inches. The explosive comprised between one and twelve 3"×5" sheets of 2-mm-thick PETN sheet explosive. One sheet comprising approximately 16 grams produces a slower fluid blade than do 12 sheets, comprising approximately 192 grams of explosive.

Variations of these relative dimensions can be used in other embodiments. For example, fluid blades generally similar to those produced by the previous embodiment would be expected for depths between approximately ¼ and ¾ of the container depth and for concavity widths between approximately ¼ and ¾ of the width of the fluid container. Different relative dimensions are usable but may alter the blade shape.

When a symmetric fluid blade shape is desired, it is helpful to have the explosively symmetrically disposed relative to the concavity. Unsymmetrical explosive configurations and/or unsymmetrical or off-center initiation can produce less symmetrical fluid blade shapes, which may be desired in applications of some embodiments.

The shape of the container can be varied widely in different embodiments. For example, the general container shape can be a circular cylinder, and oval cylinder, a triangular prism, a polygonal prism, and many other regular and irregular geometric shapes. It may be designed in such a way as to minimize the amount of container-related impact on an intended target or on collateral regions. For example, the container design can be adjusted to produce minimal impact and/or back blast in a region where a robot or robot arm may be in use to position the fluid blade device. In some applications, when it may be desirable to minimize potential hazards associated with container fragments, it may be desirable to include weak point and/or stress risers in the container to controllably engineer the way in which the container will fragment. The container can be made from a range of materials including metals and plastics. The use of a suitable plastic can reduce fragmentation relative to that produced using metal. The container can be made of combinations of different materials. Example of some materials that can be used alone or in combination include but are not restricted to plastics, metals, plaster, sand, and dense frangible materials that disintegrate into small fragments upon detonation.

In some embodiments, a hybrid fluid blade device comprising a mechanically weaker side containing the concavity and other sides that are mechanically stronger. The mechanically stronger portion can be constructed of metal or other material that does not fragment during detonation can be employed. The weaker portion of the device can be replaceable after detonation. Plastic is one material type suitable for construction of the weaker portion. Thin metal is also suitable. The very effective tamping of the stronger portion of the container can increase the efficiency of the fluid blade device by preventing venting of the detonation gases for a longer time, forcing most of the fluid toward the intended target. A wide variety of shapes of the mechanically stronger portion that serves as an outer tamping container can be employed in different embodiments, and such shapes are within the scope of the present invention. One such embodiment is illustrated in cross-section in FIG. 8. An outer container 74 substantially encloses the inner container 62 on three of four sides. A portion of the forth side can also be enclosed provided the deformation of the concavity is not excessively impeded. Enclosure of the plastic container on top and bottom sides (not illustrated) of the plastic container 62 can optionally be employed. The outer tamping container 74 can be substantially solid, or it can be hollowed out to permit filling with a fluid, a solid material, such as powder or particles, or a mixture of a fluid and particles or powder. The explosive assembly 70 and detonating means 72 are positioned opposite the bottom 64 of the concavity 66. The cavity 60 within the inner container 62 is to be filled with the blade-forming fluid before detonation. The outer tamping container can be solid, partially hollow, or substantially hollow. The outer tamping container can be filled in different regions with different materials. For example, the material in the side portions 78 can be the same or different from that in the back portion 76.

Some factors affecting the directing of energy into the blade by tamping effects include the size and shape of container and the cavities therein, the materials employed in the fluid blade device, and the location and type of fluid used in the device. Greater mass on the backside of the explosive (opposite the side facing the concavity) directs more energy into blade formation. In some embodiments, for the embodiment illustrated in FIGS. 1-3, fluid is used for tamping. The amount and configuration of tamping fluid is selected to be sufficient to prevent venting of the detonation gases before they effectively produce the fluid blade.

For an embodiment where a spike-like blade was desired, a concavity with a right circular cylindrical shape with a hemispherical bottom shape can be used. A cylindrical explosive with a diameter approximately equal to or greater than the diameter of the concavity can be used. An alternative concavity shape for producing a spike-like blade is a conical concavity.

Fluid blades of different geometries can be generated by employing concavities of different cross-sectional shapes in various embodiments. For example, an elongated trough shape produces a cleaver-like blade. An elliptical-trough cross-sectional shape will produce an elliptical blade; a circular blade will be produced when the ellipse is a circle. Two perpendicularly intersecting troughs will produce a 4-bladed-broadhead arrowhead-shaped blade. Three troughs oriented at acute angles with respect to each other will produce a three-bladed-broadhead arrowhead-shaped blade. Use of 60-degree angles will provide a radially symmetric blade. Other embodiments can be implemented wherein the shape of the fluid blade is determined by the cross-sectional profile of the concavity.

Figure 4B:
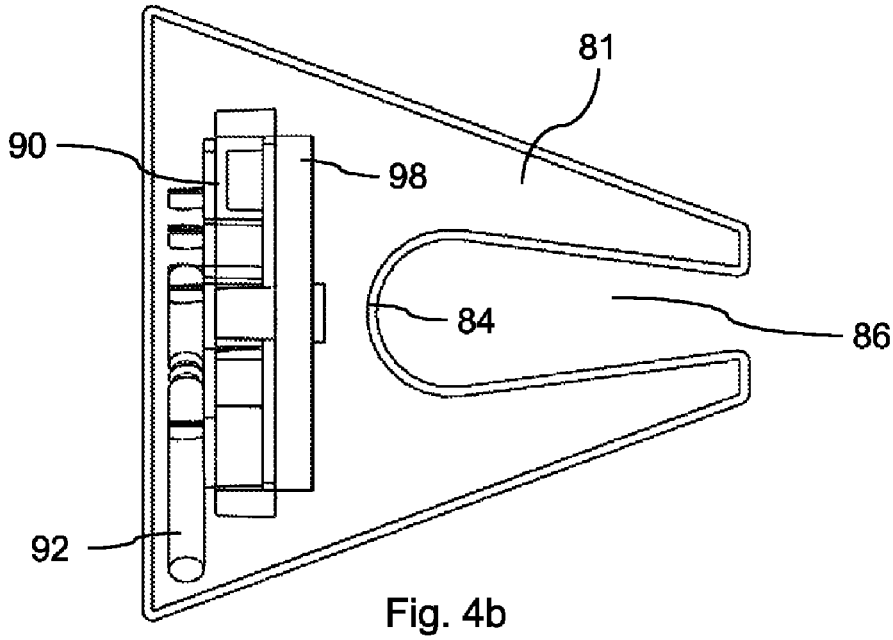
FIG. 4 illustrates an embodiment wherein the container is open on top and the explosive assembly is positioned within the cavity with top access to the explosive assembly.
Figure 4A:
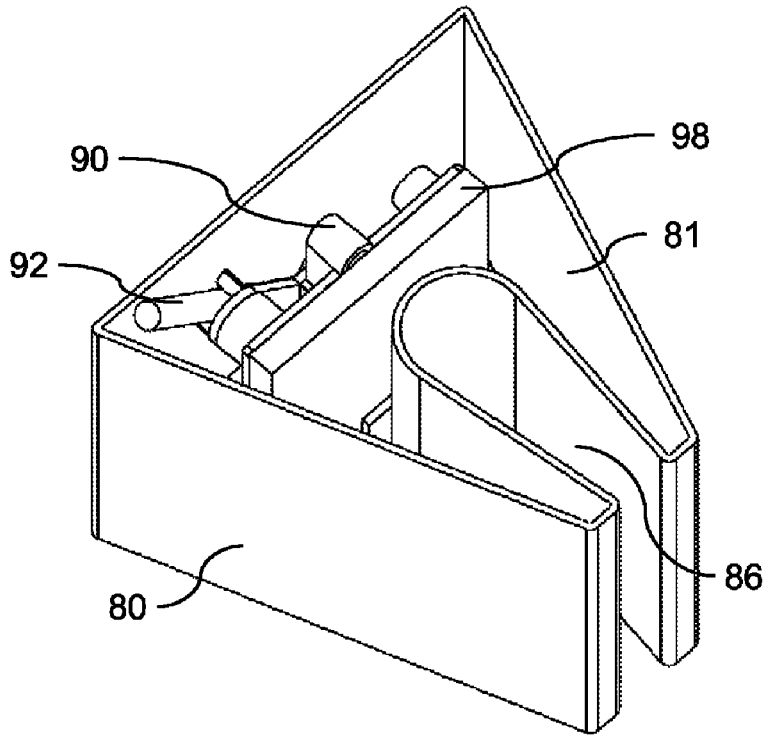

FIG. 4 illustrates an embodiment where the container is open on the top, where FIG. 4*a* is a perspective view and FIG. 4*b* is a top view. The container 80 comprises a concavity 86 and a cavity 81 which is to be filled with blade fluid to a depth sufficient to provide tamping to direct the explosive energy toward the bottom 84 of the concavity 86. An explosive assembly is positioned within the cavity 81. The explosive assembly comprises explosive 94 mounted on an explosive holder 90. In this embodiment, the explosive holder comprises a substrate configured to provide multipoint initiation of the explosive. The substrate for multipoint detonation can communicate the detonation wave from the detonator 92 to two or more points of the main explosive charge. In this embodiment, the detonator 92 is configured to initiate explosive that is incorporated in depressions in the explosive holder 90. The depressions in the explosive holder are positioned to produce detonation of the explosive in a symmetric and controlled manner. An embodiment similar to that in FIG. 4 has been employed to open a hole in ⅛" mild steel plate using 46 grams of sheet explosive (PETN) placed 2 inches from the steel plate. In the illustrated embodiment of FIG. 4, the detonator is accessed from above the top of the container. In alternative embodiments, the explosive assembly can be configured to mount adjacent to a detonator that penetrates the container wall, as illustrated schematically in cross-section in FIG. 5.

Figure 6:
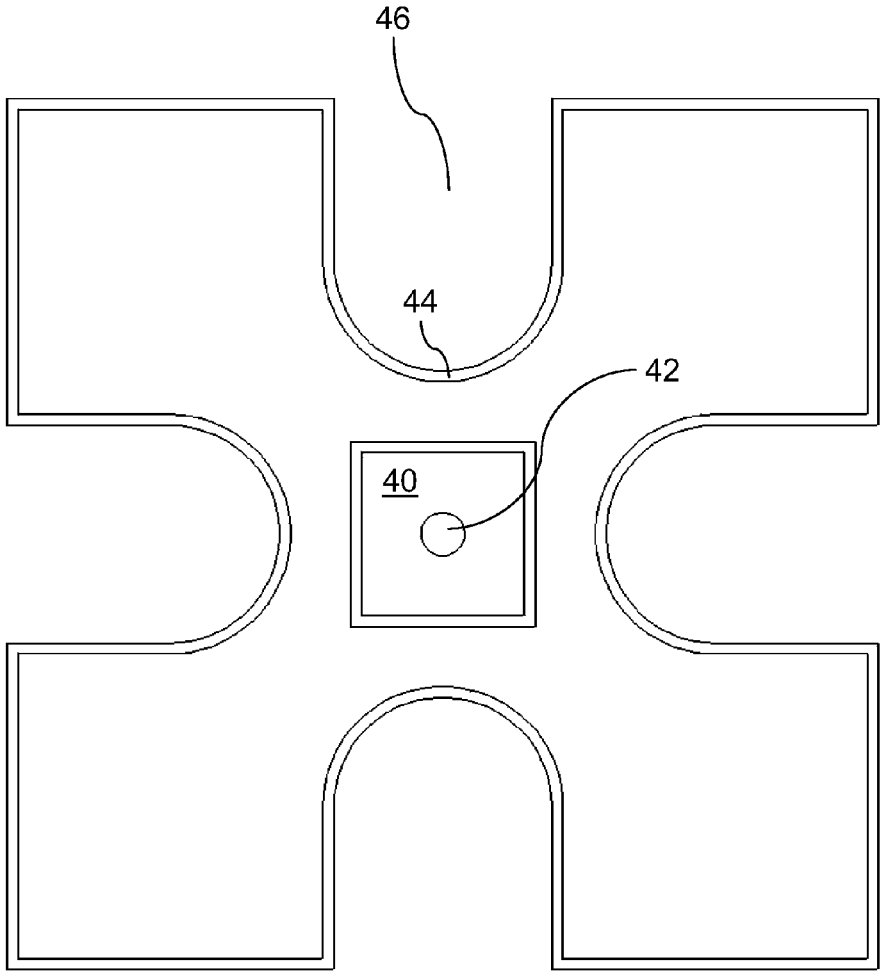
FIG. 6 presents a cross-sectional view of an embodiment with four concavities that will produce four fluid blades projected at right angles to each other.
Figure 7:
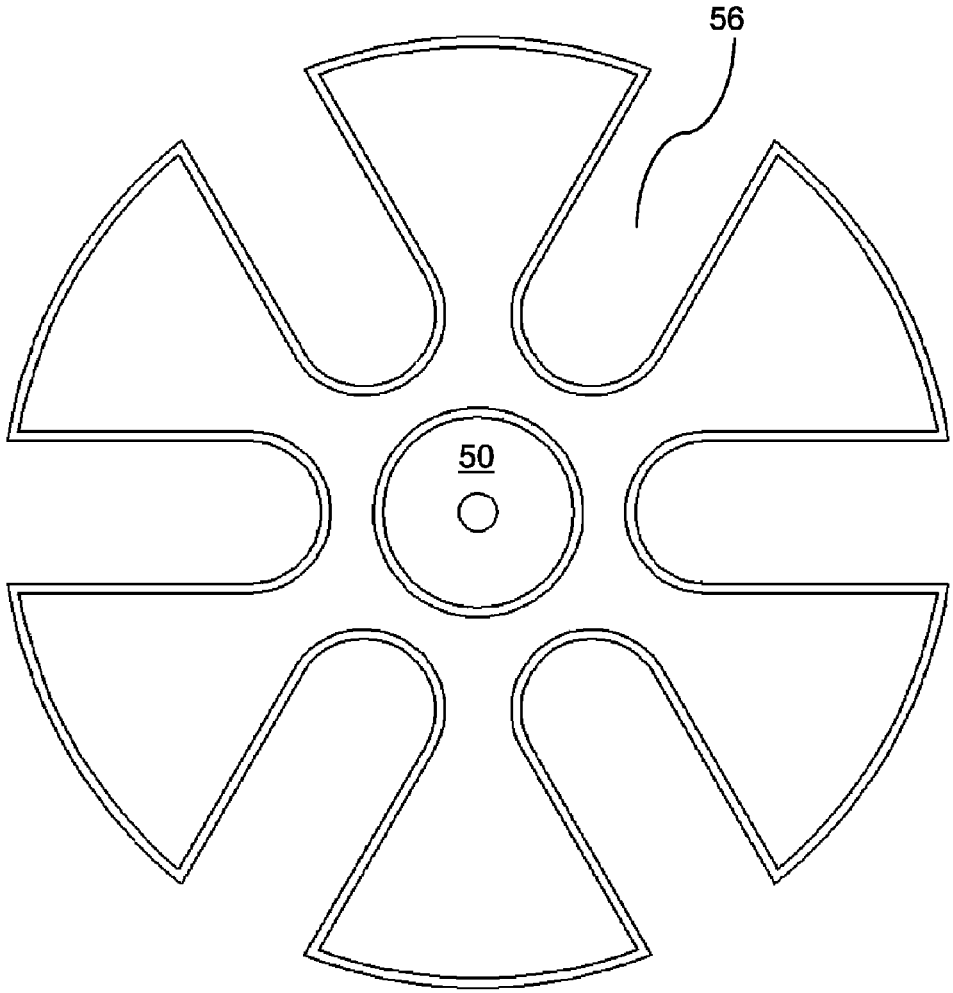
FIG. 7 presents a cross-sectional view of an embodiment that will produce six fluid blades.

In some embodiments, a plurality of concavities can be employed to generate several fluid blades that are directed in different directions relative to the container. Examples of two such embodiments are presented schematically in cross-section in FIGS. 6 and 7. In FIG. 6, an explosive holder 40 positions explosive with respect to the bottoms of the concavity wells 44. A detonating means 42 initiates the explosive in the explosive holder 40 to generate the detonation gases that apply pressure to form four fluid blades that move outward in directions defined by the 4 concavities 46. FIG. 7 illustrates schematically an embodiment where detonation of the explosive in the explosive holder 50 will generate fluid blades in six directions as defined by the 6 concavities 56. Since the concavity location defines the direction in which an associated fluid blade will travel, embodiments with different geometric arrangements of concavities can be employed to generate multiple fluid blades in directions determined by the concavity geometries. The geometric distribution of multiple blades can be symmetric, as in the illustrations, or asymmetric, such as, for example, in an embodiment where concavities are located on two or three of a four-sided container.

Figure 8:
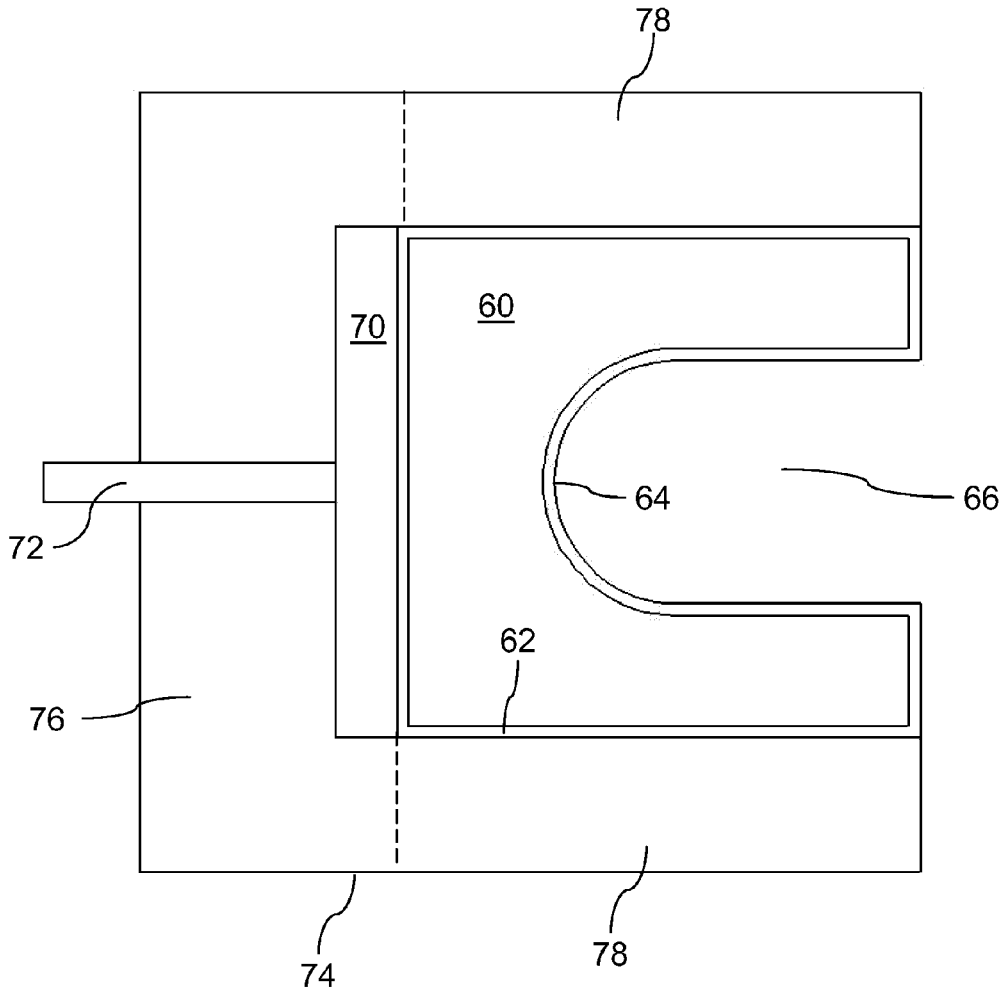
FIG. 8 presents an embodiment where material other than the fluid that will form the blade may be used as the tamping material to increase the explosive force directed into formation of the blade.
Figure 9A:
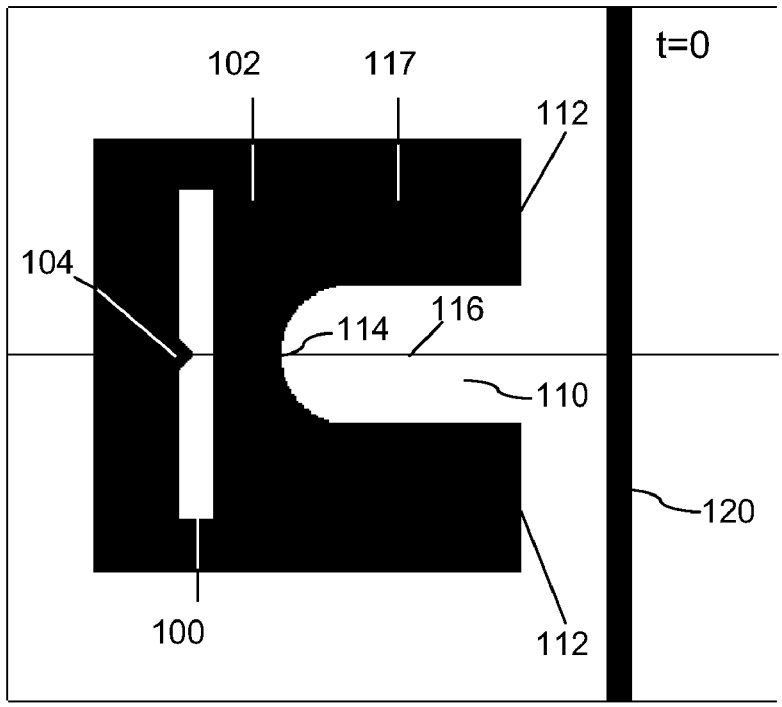
FIG. 9 presents the simulated evolution in time of expansion of detonation gases to produce the fluid blade and the secondary impacting body of fluid.
Figure 9B:
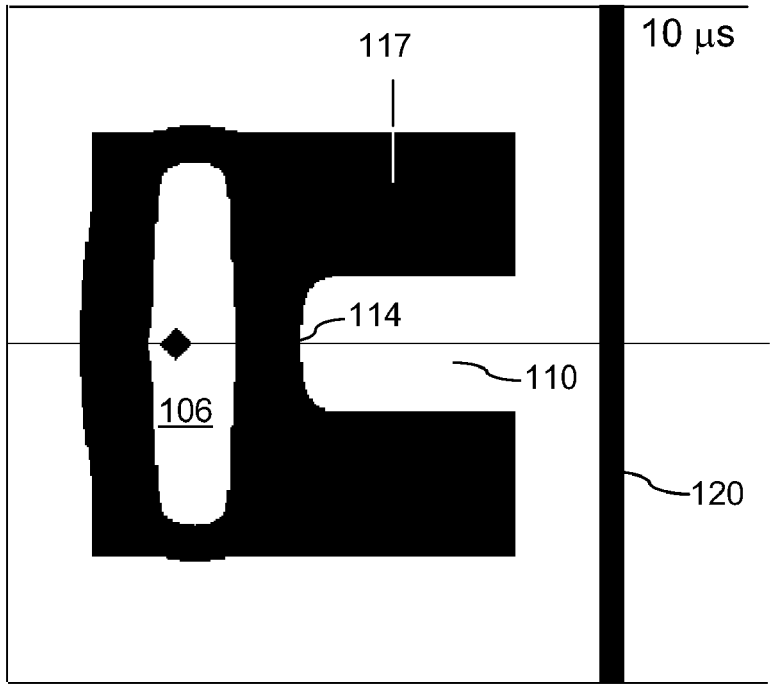
Figure 9C:
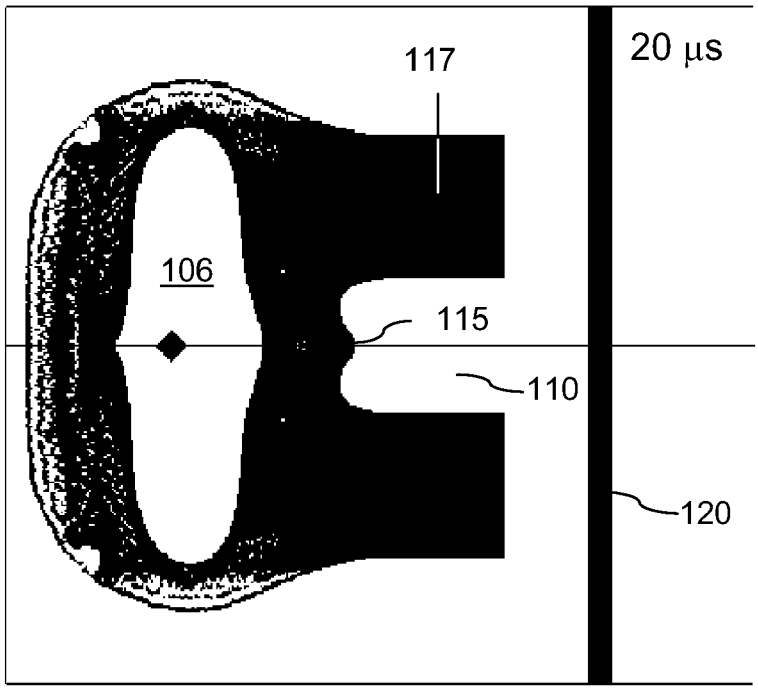
Figure 9D:
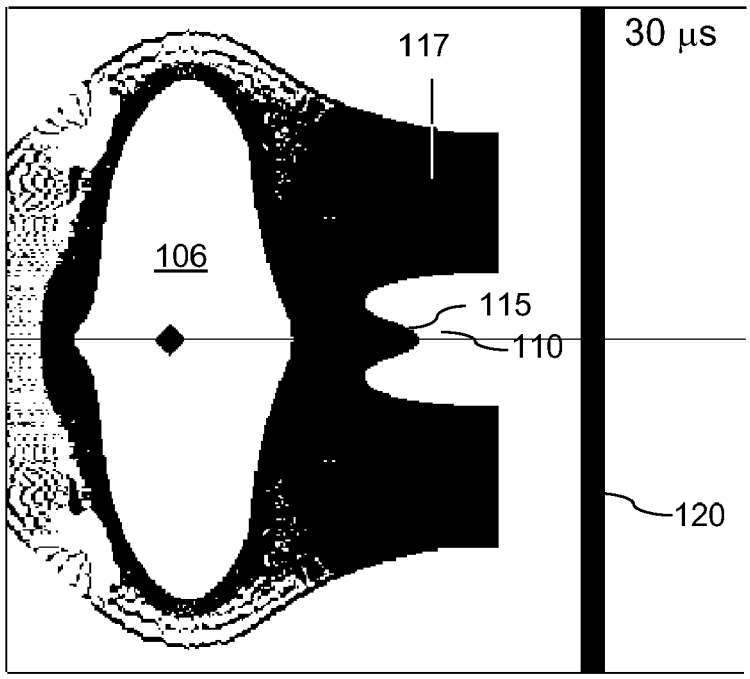
Figure 9E:
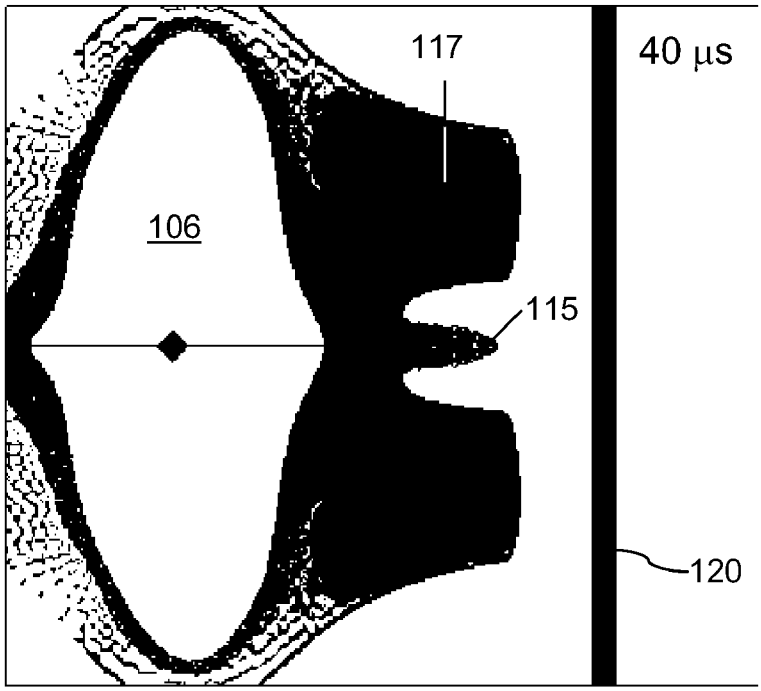
Figure 9F:
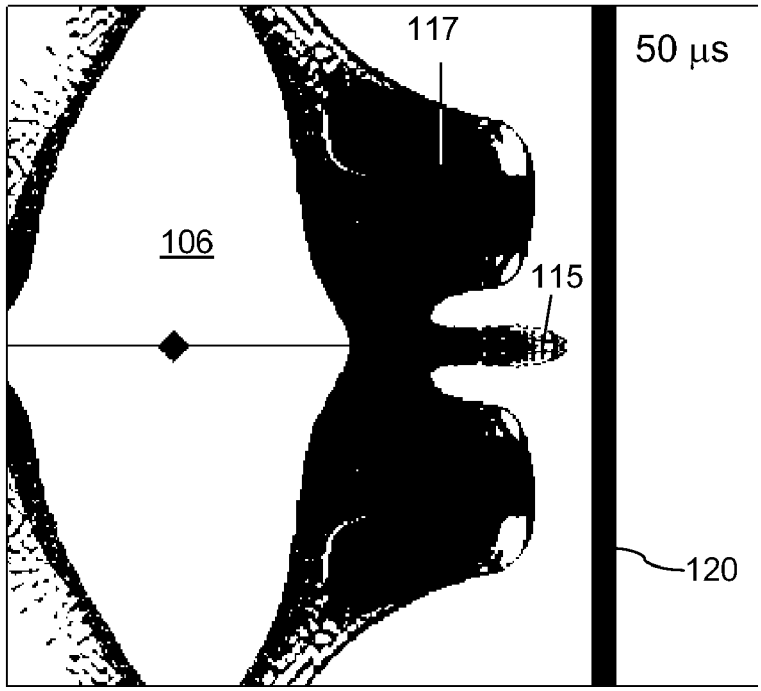
Figure 9G:
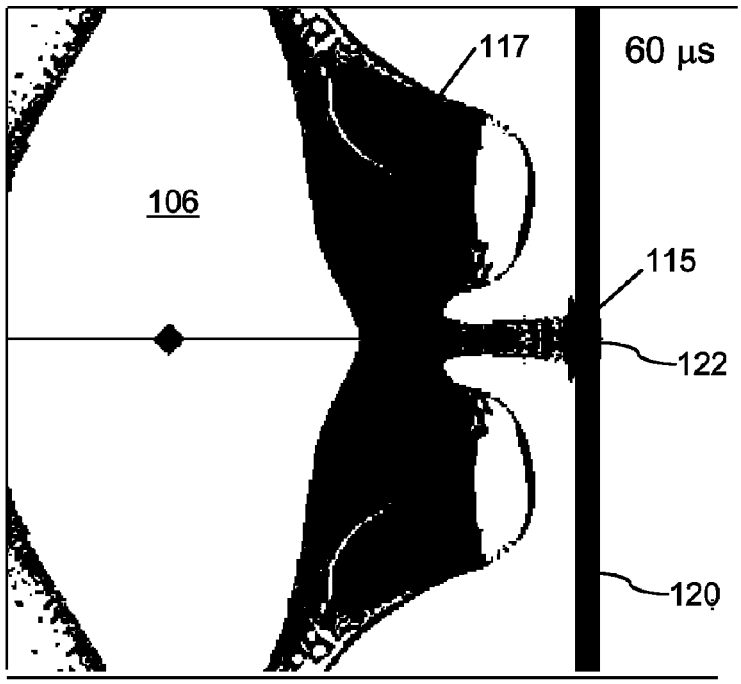
Figure 9H:
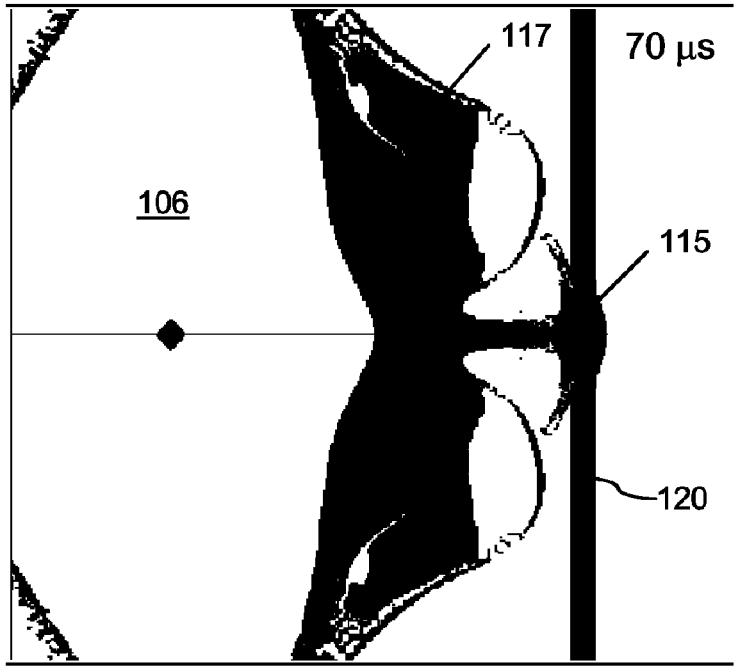
Figure 9I:
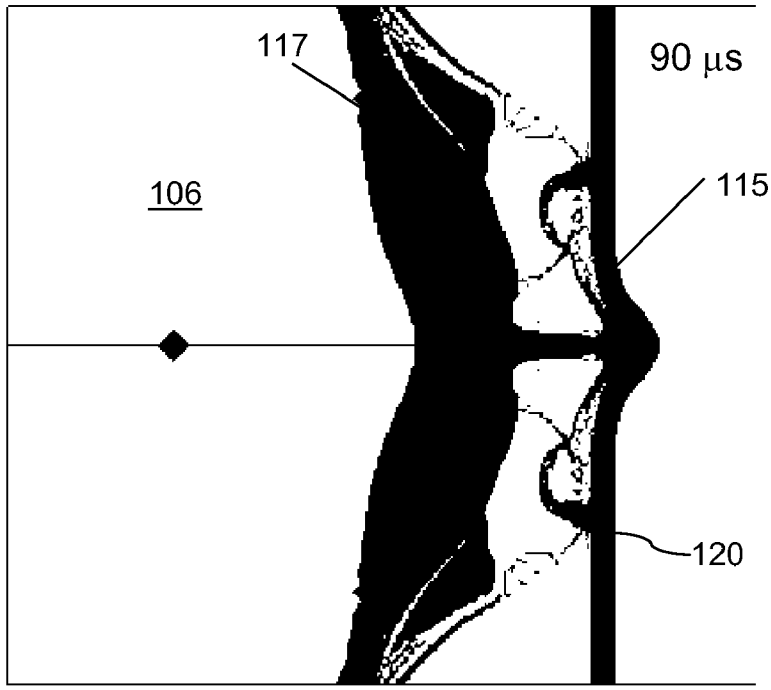
Figure 9J:
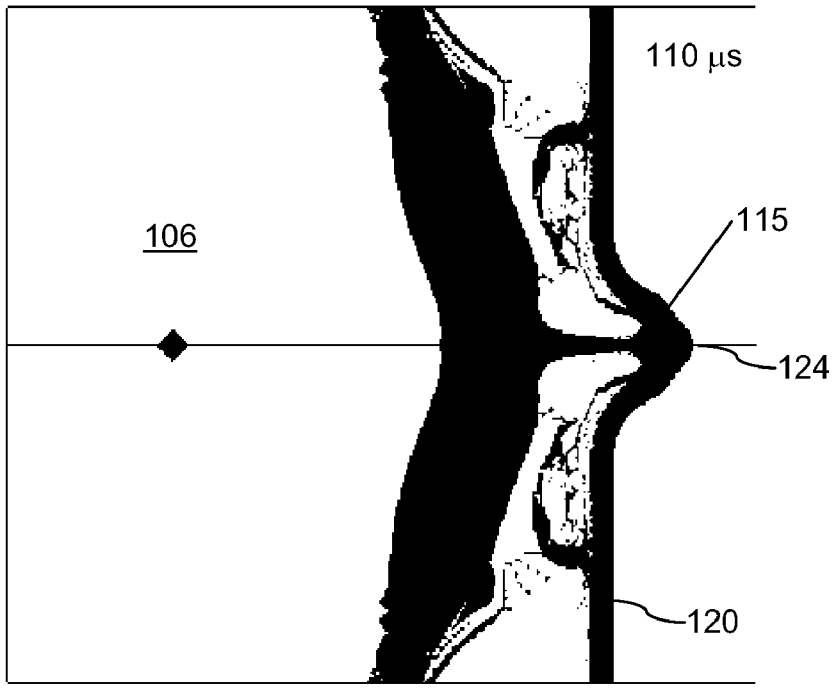
Figure 9K:
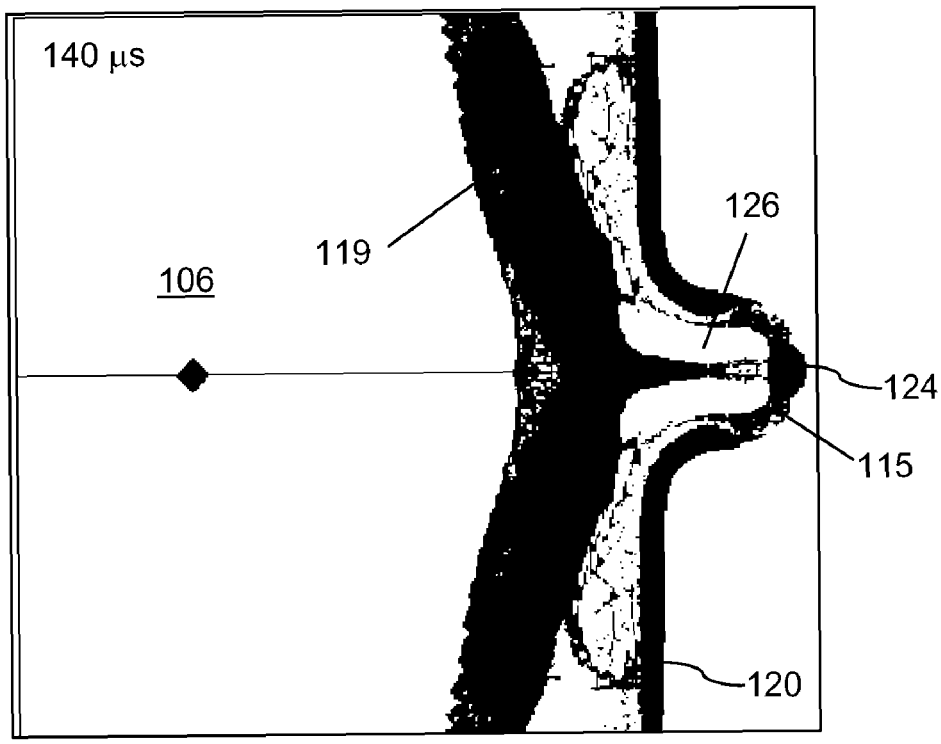
Figure 9L:
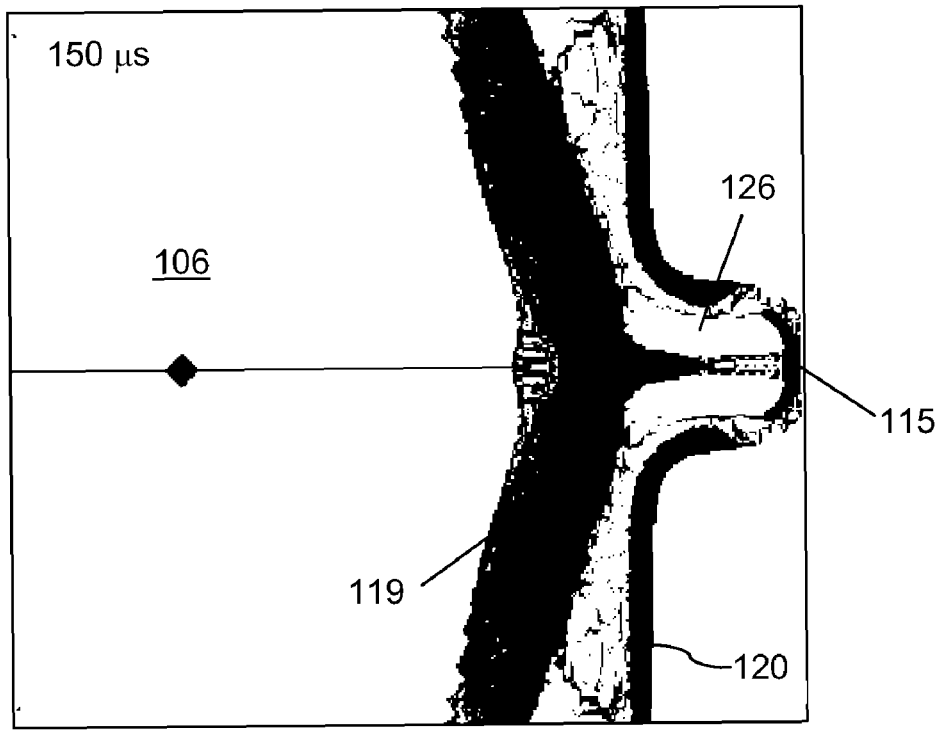
Figure 9M:
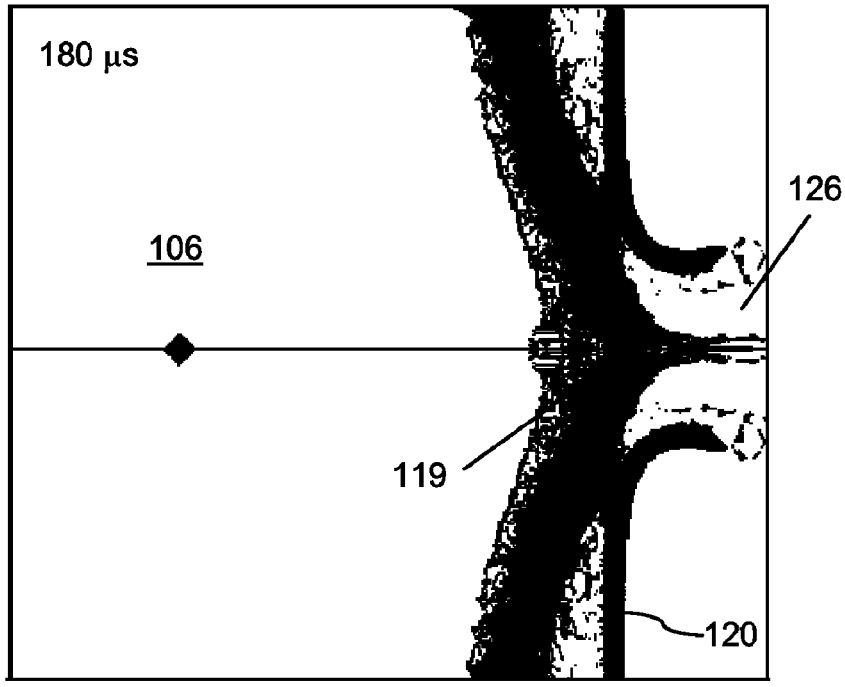
Figure 9N:
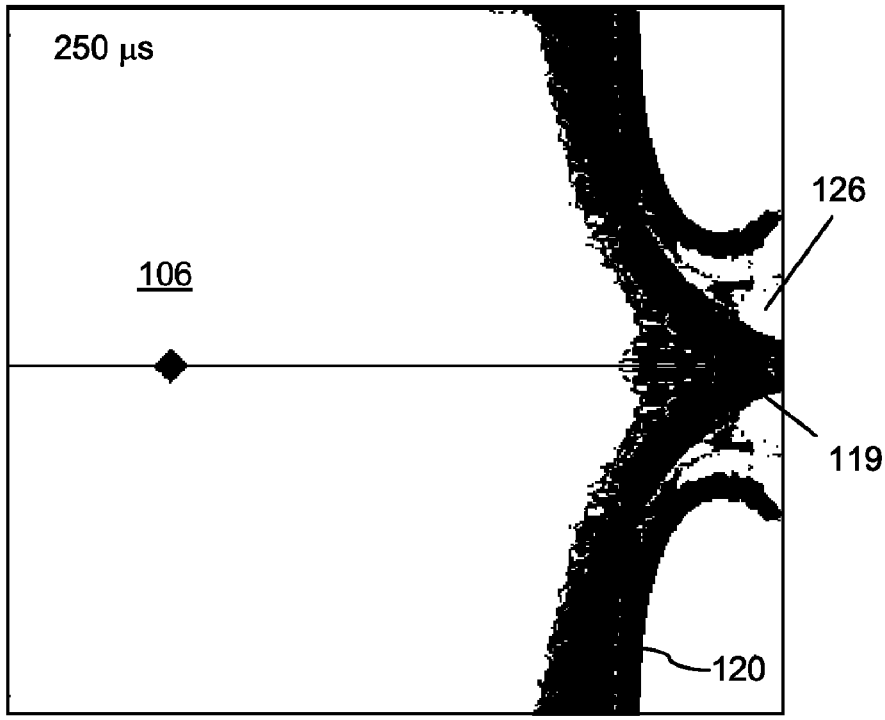
Figure 9O:
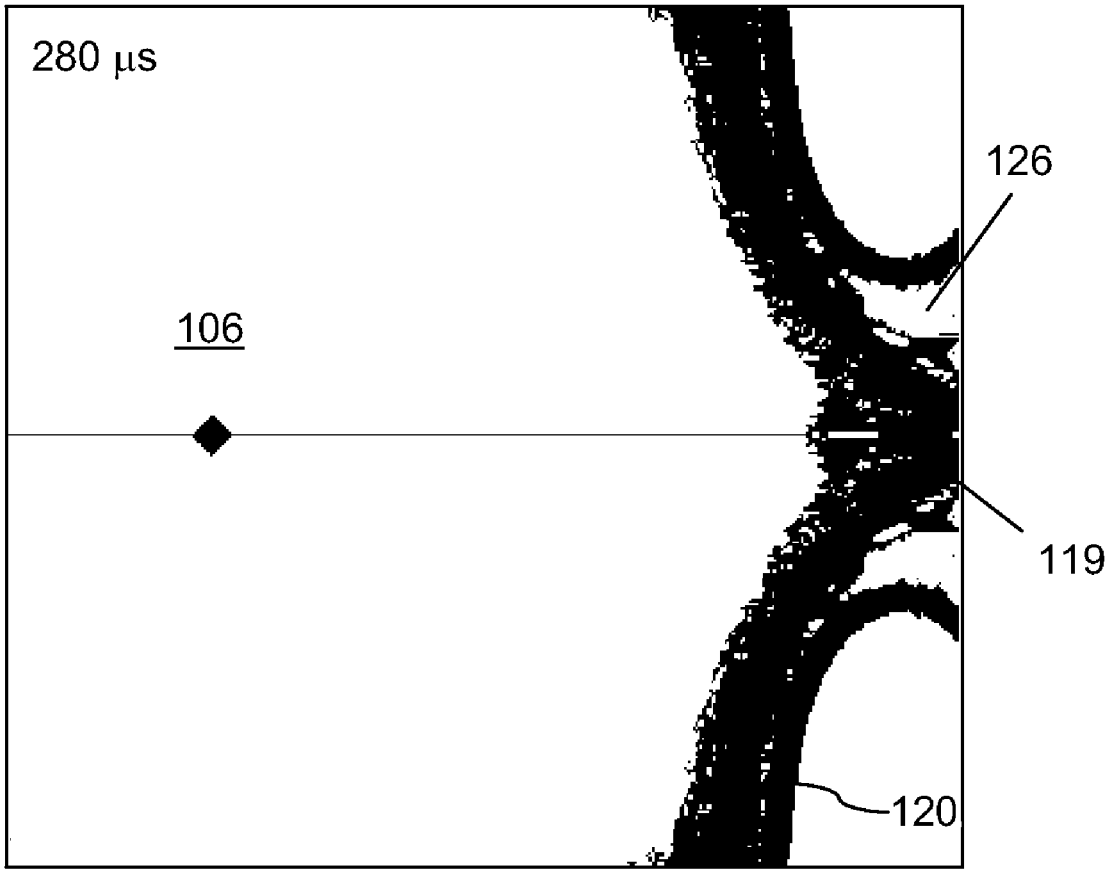

FIG. 8 presents schematically a cross-section of an embodiment using additional tamping materials other than the fluid that comprises the blade. A container 60 for containing the blade fluid comprises a concavity 66 with a concavity bottom 64 located relative to the explosive assembly 70 such that detonation of explosive within the assembly 70 by the detonating means 72 will generate a fluid blade. On one or more sides of the container 60 are in contact with tamping material 74. The tamping material can be of a wide variety. Suitable tamping materials include but are not restricted to solid metals, powdered metals, steel, copper, copper powder, tungsten, tungsten powder, aluminum, aluminum powder, sand, heavy liquids, heavy frangible material, and combinations of these with or without a fluid in combination with these. A liquid is considered heavy when it is a liquid with a density greater than water or is a liquid with suspended solids or dissolved materials such that its density is greater than the density of water.

A wide variety of working fluids can be used as the blade fluid. Pure fluids such as water can be used. A convenient fluid is water, but many other fluids may be used. Most fluids that are not incompatible with the explosive are usable. Silicon oil is a useful fluid that is nonflammable and an excellent electrical insulator. Liquids with additives can also be used. For example, additives that increase the density of the fluid can be used. Changing the concentration of additives allows variation of the density of the blade fluid. For example, a solution of water and sodium polytungstate can be made with Densities that are tailorable between 1.0 and 3.1 grams/cm$^3$. Higher density fluids can more easily penetrate through thick metal barriers. If the shock impedance of the detonation gases is matched to the fluid, i.e., if a fluid with a density of about 2 g/cm$^3$ is used, the number of reflected shock waves can be minimized and the energy transfer from the explosive to the working fluid can be maximized. In some embodiments, one may want to use a fluid that could dissolve the contents of the container that the fluid blade penetrates. For example if the container is an IED, a fluid that could dissolve high explosives might be employed. In some embodiments, mixtures of two or more liquids may be used to lower freezing points or raise boiling points. An example is propylene glycol and water. In some embodiments, fire-extinguishing compounds may be added to the primary liquid. In some embodiments, fluids with salts dissolved therein may be used. Mixtures of particles, such as sand and/or abrasive compounds with the main liquid can be used. Mixtures of metal particles with the main fluid can be used. Metals that can be so used include but are not restricted to tungsten, steel, tantalum, brass, and other metals not chemically incompatible with the main fluid.

For the embodiment illustrated schematically in FIGS. 1-3, the legs 14 function both as legs and as clamps. In many embodiments, legs may be affixed to the container in such a way that they do not also serve as clamps. Legs can be optionally used in various embodiments and serve a function in controlling the tamping of the explosive forces. By reducing the direct contact of the container with environmental surfaces, legs provide more uniform tamping in different applications of a given embodiment, thereby providing more uniform and predictable deposition of explosive energy into the formation of the fluid blade. The details of the leg design can be highly variable. For example, the waffle-like legs illustrated in FIGS. 1-3 present a design that is amenable to plastic casting where it is helpful to have relatively uniform thickness of various parts of a structure. In other embodiments, different leg designs can be used, such as, for example, solid legs and open-grid-work legs. For particular applications where reduction of tamping effects might be considered desirable, low mass, low density legs can help achieve that goal. However, a wide array of leg designs can be used, such as are known to those of skill in the mechanical art.

The principle of operation of embodiments of this invention following detonation is illustrated in FIG. 9 in two dimensions for a device with a substantially U-shaped trough using water as the fluid 102. The pre-detonation configuration is illustrated in FIG. 9*a*. It has been determined by comparison of simulations that a plastic container with wall thicknesses less than approximately 0.1 inch does not appreciably perturb the behavior of the detonation gases and the fluid compared to the idealized behavior of the fluid where the simulation does not specifically include the container wall. FIGS. 9 and 10 illustrate the time-evolution of the expanding fluid projectiles assume a non-perturbing thin-wall construction of the container so that the container need not be explicitly included in the simulation. The initial shape of the fluid 102, as defined by the container for one particular embodiment, is approximately 10 cm×10 cm with a U-shaped concavity 110 extending approximately 5.6 cm inward from the outer front edge 112. Before detonation, the explosive 100 is positioned to be separated from the concavity by approximately 1.5 cm of fluid (water in this embodiment) between the front surface of the explosive 100 and the center bottom 114 of the concavity (trough). The explosive is a plastic explosive (PETN) of approximately 0.8 cm thickness. Detonation is initiated at the back side of the explosive at a point 104 approximately aligned with the bisector 116 of the trough. A steel wall 120 that is 0.5 cm thick is positioned approximately 10 cm from the detonation point 104. In FIGS. 9*b*-9*o*, the wall to be penetrated is 120 and the expanding detonation gases are 106.

Approximately 10 microseconds after detonation (FIG. 9*b*), the expanding detonation gases 106 have begun flattening the bottom 114 of the trough. By approximately 20 microseconds after detonation (FIG. 9*c*), the detonation gases 106 have the inversion of the curvature at the bottom of the trough can be clearly seen and a nascent fluid blade 115 has appeared. After 30 microseconds (FIG. 9*d*), the blade 115 is more clearly developed but has not yet passed the edge of the fluid in the regions 117 adjacent to the concavity. The blade is moving away from the detonation point at higher velocity than the fluid in the adjacent region 117. Between 40 microseconds (FIG. 9*e*) and 50 microseconds (FIG. 9*f*), the blade is well developed and extends past the adjacent fluid regions. At approximately 60 microseconds (FIG. 9*g*), the fluid blade has reached the metal wall 120 and has begun deforming the wall at the location 122 where penetration of the wall will occur. At approximately 70 microseconds (FIG. 9*h*) and 90 microseconds (FIG. 9*i*), the deformation of the wall has continued to increase in response to the pressure from the fluid blade 115 and the general shape of the fluid 117 that will provide the secondary disrupting effect is seen to be somewhat flattening out. Between approximately 110 microseconds (FIG. 9*j*) and 140 microseconds (FIG. 9*k*), the fluid blade penetrates the wall, producing an aperture 126. The aperture may be a tear in the metal wall or the fluid blade 115 may punch through the wall such that a portion of the wall 124 is carried forward atop the advancing blade. The expanding detonation gases have reshaped a portion of the fluid in the container into a forward-moving body of water 119 that is positioned for entry into and passage through the aperture 126 that the fluid blade 115 has opened. FIGS. 9*l* through 9*o* illustrate the progression of the body of water 119 into and through the aperture 126 to provide disruption of whatever lies behind the wall.

Figure 10A:
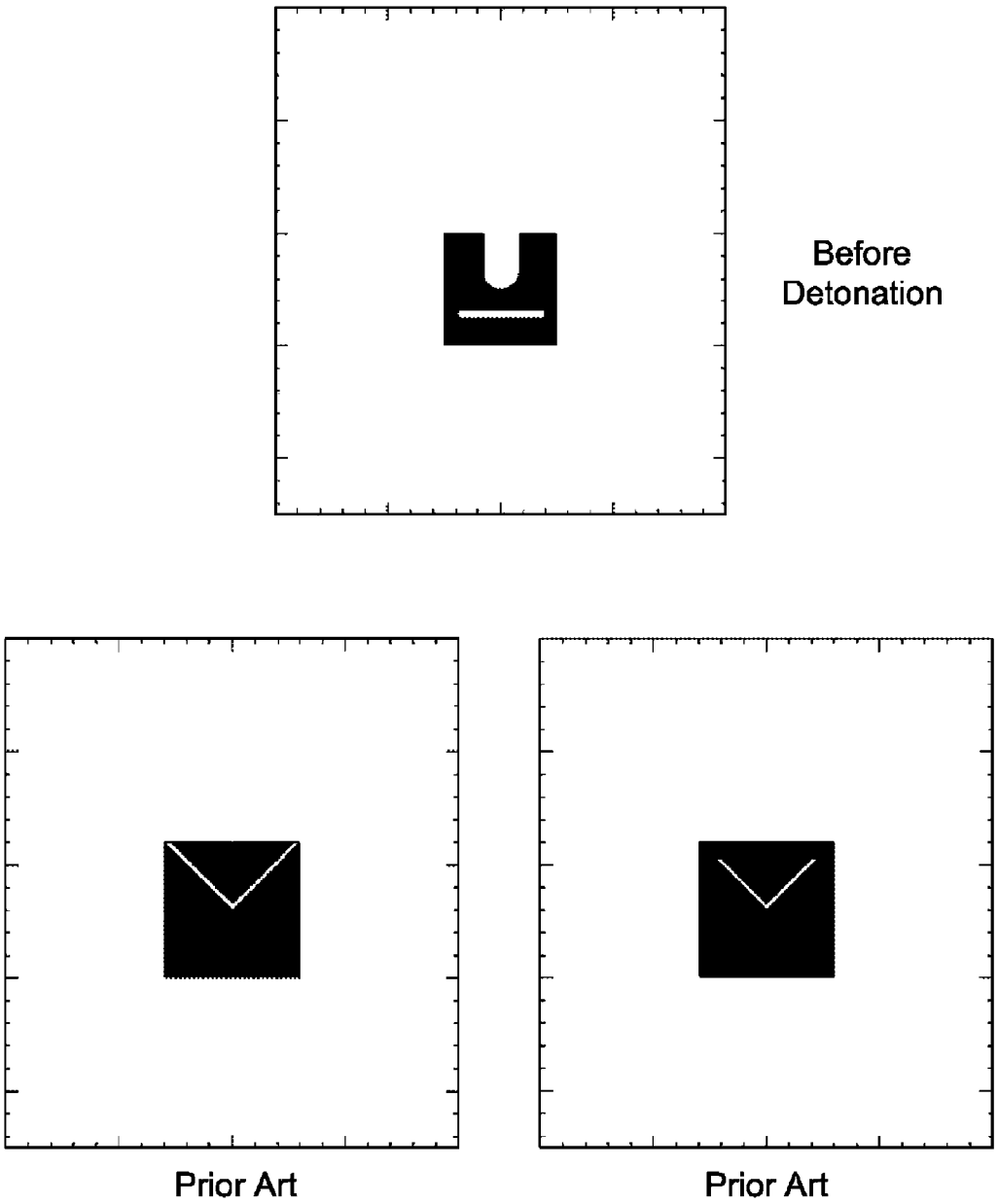
FIG. 10 presents a simulated comparison of the evolution in time of the expanding detonation gases and water projectiles of this present invention and of two variations of a chevron-based fluid projectile device.
Figure 10B:
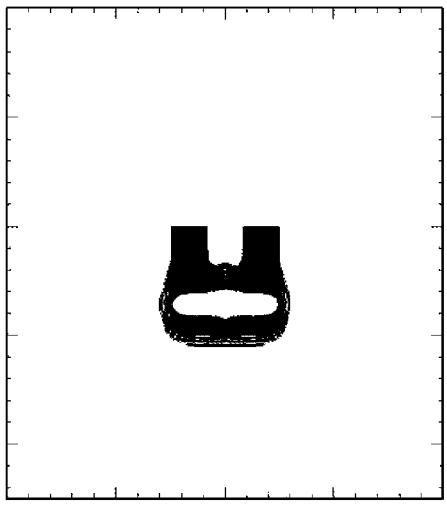
Prior Art Fig. 10b
Figure 10B:
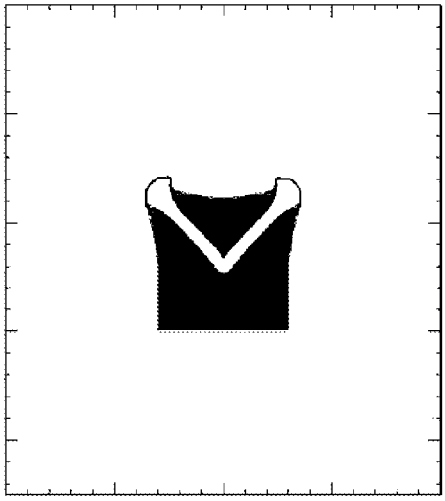
Prior Art Fig. 10b
Figure 10B:
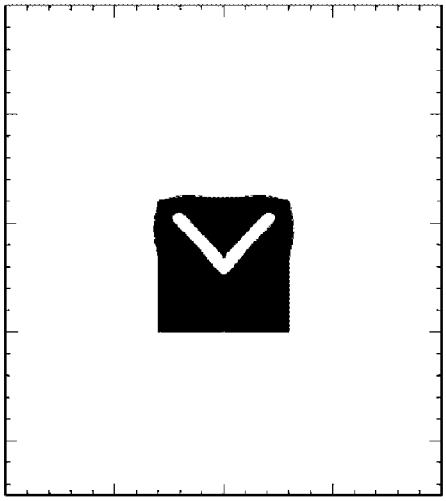
Prior Art Fig. 10b

The benefit of the concavity in providing a relatively sharp fluid blade is illustrated in FIGS. 10*a-f* in comparison simulation of the time-dependent behavior of the fluid of the FBD tool and a prior-art tool using a chevron of explosive without a concavity. A distinct difference in the principle of operation of these two types of devices is illustrated by the simulations. In the prior art tool, it is important for the detonation gases to vent and advance ahead of the fluid toward the target. These gases traveling in advance of the fluid serve to focus an incoherent mass of water into a broad projectile that can deliver a hammer-like blow. Without the focusing effect of the gases, the broad dull-blade-like or hammer-like projectile does not form well. In embodiments of the FDB tool, the detonation gases do not vent and move ahead of the fluid. The proximity of the relatively weak concavity bottom to the explosive allows the expanding detonation gases to push the fluid between the explosive and the concavity bottom outward to form the sharp fluid blade before substantial venting occurs. In embodiments of this invention, substantial venting can be delayed for several 10s of microseconds and even for more than 100 microseconds. This enables concentration of the energy into the formation of the fluid blade. The other fluid in the container that is not initially in the narrow container region between the concavity and the explosive is propelled by the gases in a broader body to provide a hammer-like blow following the focused impact of the blade. The pre-detonation configuration is illustrated in FIG. 10*a* for the FBD tool and for two chevron-type configurations where the ends of the chevron are enclosed by fluid or not. The same mass of explosive is employed in the FBD tool and in the end-exposed chevron tool. The end-enclosed tool is like the end-exposed tool but with approximately ½ inch explosive removed from the chevron ends to allow the fluid to cover the ends. The black regions are the fluid. In FIG. 10*a*, the white rectangle and chevrons correspond to the explosive. In subsequent FIGS. 10*b*-10*f*, the corresponding white regions 206, 236 represent the expanding detonation gases. At 20 microseconds after detonation (FIG. 10*b*), the nascent fluid blade 215 is forming with the FBD tool. For the exposed-chevron tool, expanding detonation gases 226 are beginning to accelerate and shape a broad fluid projectile 225. The expanding detonation gases of the enclosed-chevron tool 236 are pushing fluid 235 forward but not appreciably focusing the fluid into a compact projectile. After 40 microseconds (FIG. 10*c*), the fluid blade 215 of the FBD tool is now well formed and relatively sharp. The fluid projectile 225 of the exposed-chevron tool is somewhat more focused but still very broad compared to the sharp blade of the FBD tool. The expanding detonation gases of the enclosed-chevron tool 236 are pushing fluid 235 forward but still not appreciably focusing the fluid into a compact projectile. By 60 microseconds (FIG. 10*d*), the blade 215 of the FBD tool is sharp and extends past the fluid body 217 that was previously in the portions of the container that was adjacent to the concavity walls. The fluid projectile 225 of the exposed-chevron tool is slightly more focused than after 40 microseconds but still very broad compared to the sharp blade of the FBD tool. For the enclosed-chevron tool, expanding detonation gases 226 continue to accelerate but do not appreciably focus the broad fluid projectile 225 that is being pushed forward by the expanding gases. After 80 microseconds (FIG. 10*e*), the fluid blade 215 of the FBD tool is sharp. The broader fluid body that will perform the secondary disruption 217 is being pushed forward by the expanding gases 206. For the exposed-chevron tool, the expanding gases 226 have substantially completed the focusing of the fluid into the broad water projectile 225. For the enclosed-chevron tool, the water projectile 235 remains substantially unfocused by the expanding gases 236. After 100 microseconds (FIG. 10*f*), the sharp fluid blade 215 continues to be pushed ahead of the fluid body 217. For the exposed-chevron tool, the focusing effect of the expanding gases 226 is substantially complete and the shape of the broad projectile 225 is substantially the same as after 80 microseconds. Minimal additional focusing of the projectile 235 is seen for the enclosed-chevron tool. The simulation sequences described above clearly illustrate the role of the concavity in forming a very sharp fluid blade capable of penetrating container walls.

Figure 10C:
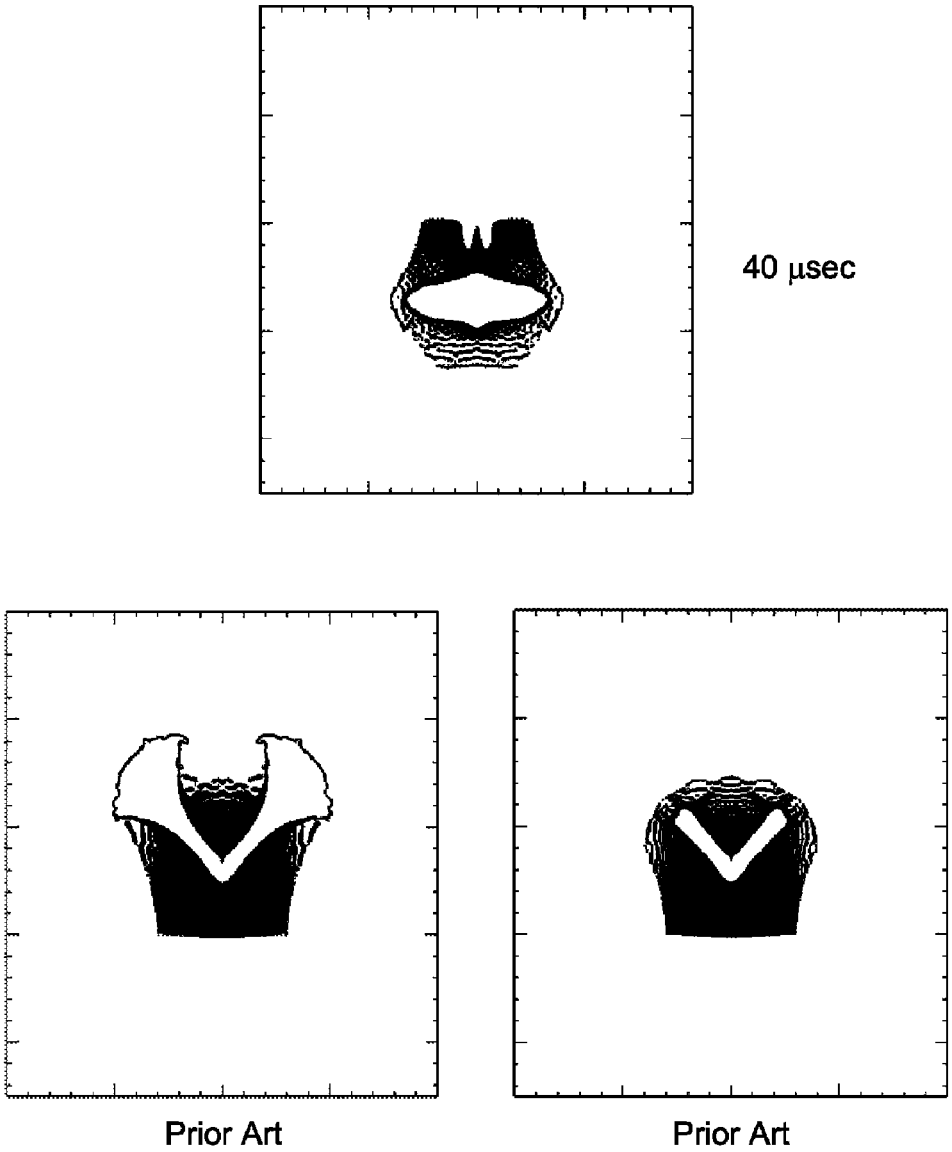
Figure 10D:
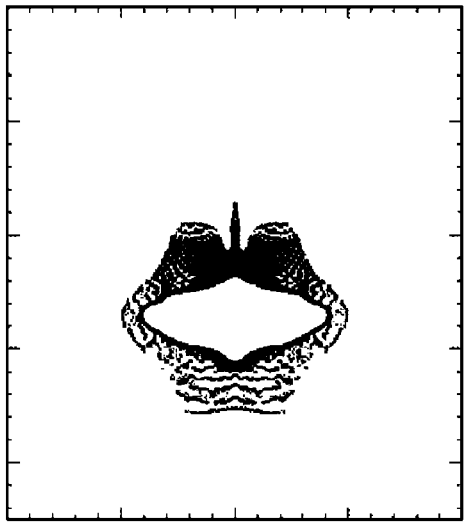
Prior Art Fig. 10d
Figure 10D:
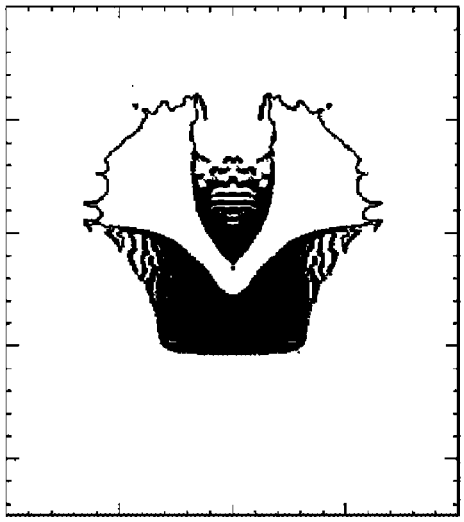
Prior Art Fig. 10d
Figure 10D:
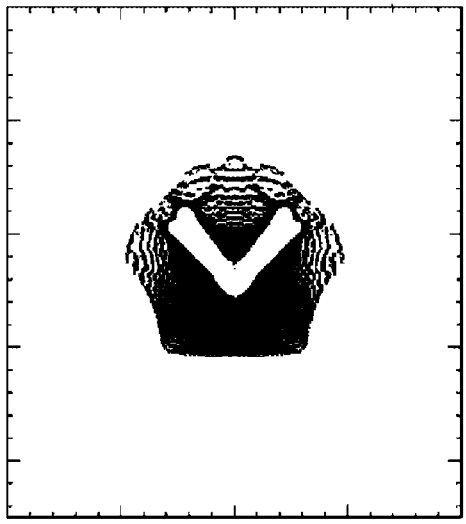
Prior Art Fig. 10d
Figure 10E:
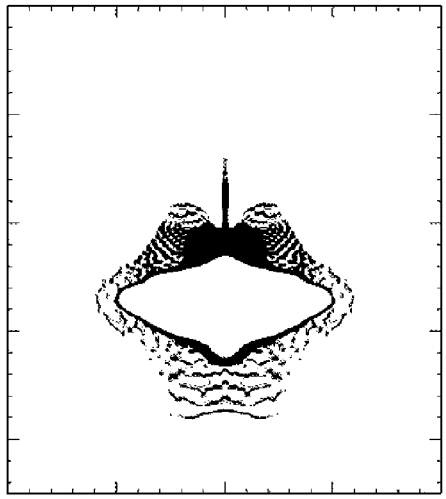
Prior Art Fig. 10e
Figure 10E:
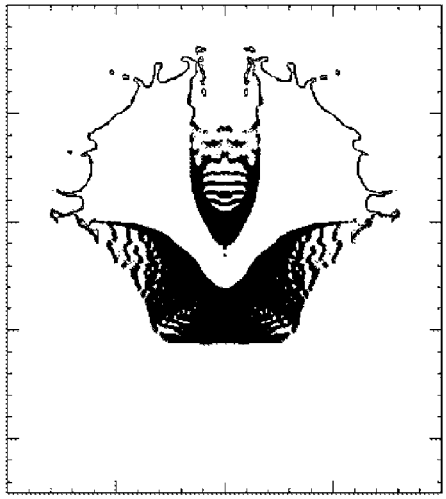
Prior Art Fig. 10e
Figure 10E:
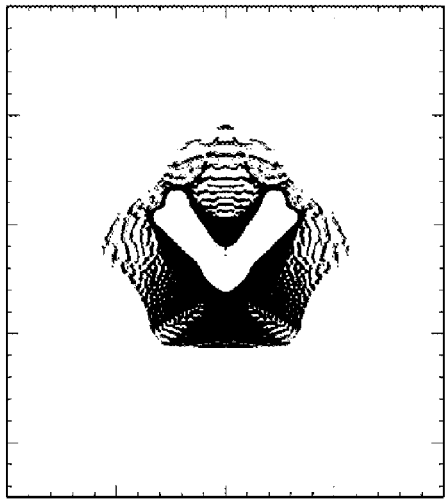
Prior Art Fig. 10e
Figure 10F:
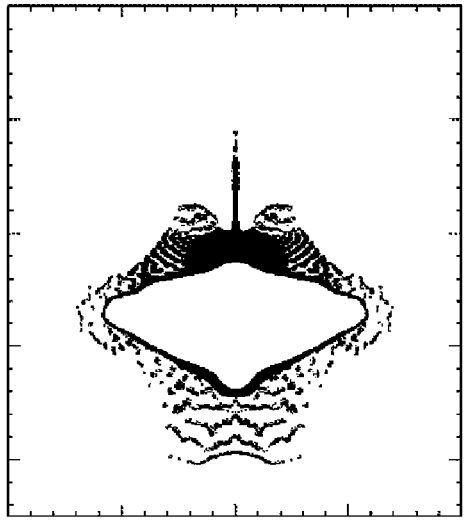
Prior Art Fig. 10f
Figure 10F:
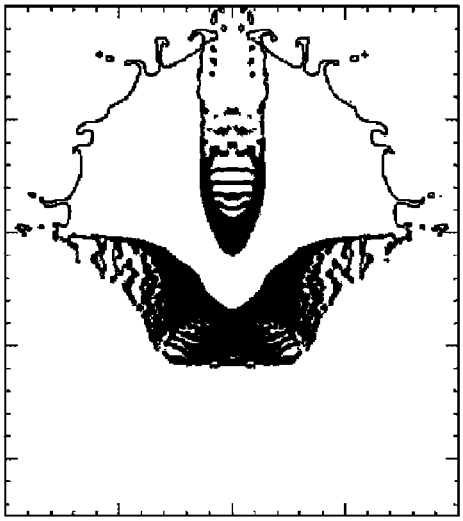
Prior Art Fig. 10f
Figure 10F:
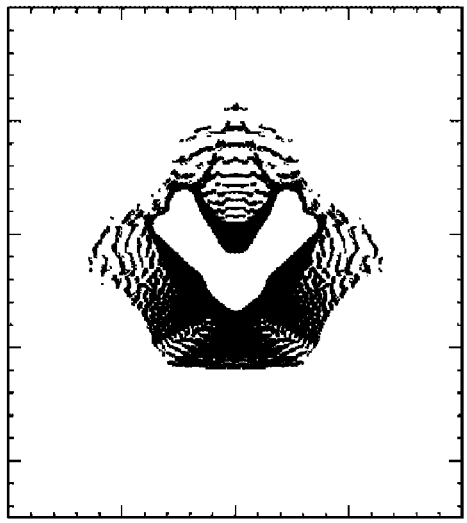
Prior Art Fig. 10f

The formation of the fluid blade within the concavity allows for it to have penetrating force when the FBD tool is placed directly against the wall to be penetrated, that is to say, the stand-off distance can be essentially zero. This is in marked contrast to prior art tool that rely on the focusing effect of the expanding detonation gases to form their fluid projectile. In such cases, a minimum separation of a few inches is generally required to form the projectile. FIG. 10*c* illustrates the difference in the well-formed, sharp blade of the FBD device within the concavity while the device that relies on fluid focusing by the expanding detonation gases requires expansion by some distance from the initial device position before a focused fluid projectile is formed. Such devices typically require a stand-off distance of a few inches before the projectile is sufficiently focused to have much penetrating power.

The FBD tool can also penetrate a wall at a long stand-off distance because the fluid blade remains well defined. A 1/16" steel wall has been penetrated at a stand-off distance of approximately 4 feet using the FBD tool. Typically, the gas-focused projectiles lose their penetrating power by approximately 18 inches.

The maximum stand-off distance for effective penetration depends on the nature of the material, the thickness of the material, and the amount and type of explosive in the FBD tool being employed. The amount of explosive energy available to form the more forceful blade that can produce penetration at longer distances can be increased by increasing explosive poser, for example, by increasing the areal size of the FBD tool and therefore of its explosive or by increasing the amount of explosive in an FBD tool of a particular size. For example, the FBD tool described above would be expected to be able to penetrate through relatively thick wood (½" thick or ¾" thick) at a standoff distance of about 6 feet. If the FBD were scaled up from its current size of about 4 inches by 4 inches by 8 inches to 200% size (8 inches by 8 inches by 16 inches), the resulting blade could be expected to penetrate ⅛" thick steel at 8 feet. If the FBD tool were scaled up from its current size of about 4 inches by 4 inches by 8 inches to 400% size (16 inches by 16 inches by 32 inches), the resulting blade could be expected to penetrate ¼" thick steel at 16 feet.

While the fluid blade disablement tool is very useful for such applications as the penetration and disablement of an IED, applications of this invention are not limited to IED disablement. The FBD tool is of utility in a wide range of application where the penetration of a barrier by the blade and the introduction of the FBD fluid to the region behind the barrier are desired.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A device for generating a fluid jet, comprising:

a container for containing fluid, the container having a concavity in a front container side, wherein the container comprises a cavity for fluid and wherein the concavity has a concavity wall thickness sufficiently thin to allow at least partial inversion of a curvature of a bottom of the concavity in response to fluid pressure when the cavity contains fluid;

an explosive assembly positioned within the container, the explosive assembly comprising an explosive holder and explosive held by the explosive holder, wherein a front side of the explosive is oriented toward the concavity and wherein the cavity for fluid is located between a plurality of walls of the container and the front side of the explosive; and a detonating means positioned for detonation of the explosive.

2. The device of claim 1, wherein the concavity comprises a trough with a trough shape and a trough bottom shape.

3. The device of claim 2, wherein the trough bottom shape is selected from the group consisting of a curved shape, a substantially flat surface, a substantially flat surface with filleted walls, a substantially flat surface with chamfered walls, a flared shape, and a wedge shape and wherein an end of the trough is selected from the group consisting of a curved surface, a filleted surface, a chamfered surface, a substantially flat surface, and an open end.

4. The device of claim 2, wherein a trough cross-sectional shape is selected from the group consisting of an elongate shape, an ellipse, a cross, and a shape comprising an intersection of a plurality of polygons.

5. The device of claim 1, further comprising a plurality of legs attached to the container and configured for reduction of variable tamping by environmental contacts with the container.

6. The device of claim 1, wherein the explosive is symmetrically disposed relative to the concavity.

7. The device of claim 1, wherein the container walls are made of a material selected from the group consisting of plastics and metals.

8. The device of claim 1, wherein at least a portion of a concavity wall comprises a material different from a material of a non-concavity wall of the container.

9. The device of claim 1, wherein the concavity wall thickness is less than approximately 0.5 inch.

10. The device of claim 1, wherein the explosive is a plastic explosive or a containerized liquid explosive.

11. The device of claim 1, wherein the explosive is selected from the group consisting of trinitrobenzene, trinitrotoluene, trinitrobenzoic acid, trinitroaniline, tetryl, ethyl tetryl, picric acid, ammonium picrate, methyl picrate, ethyl picrate, picryl chloride, trinitroxylene, trinitrocresol, styphnic acid, lead styphnate, triaminotrinitrobenzene, hexanitroazobenzene, hexanitrostilbene, tetranitrodibenzotetrazapentalene, tetranitrocarbazole, tetranitrodibenzotetrazapentalene, methyl nitrate, nitroglycol, nitroglycerine, erythritoltetranitrate, mannitol hexanitrate, pentaerythritol tetranitrate, pentaerythritol trinitrate, ethylenedinitramine, nitroguanidine, nitro urea, cyclo-1,3,5-trimethylene-2,4,6-trinitramine, cyclotetramethylenetetranitramine, tetranitroglycolurile, mercury fulminate, lead azide, silver azide, and ammonium nitrate, combinations thereof, combinations thereof with inert materials, nitromethane, and a binary liquid explosive.

12. The device of claim 1, further comprising a fluid within the cavity.

13. The device of claim 12, wherein the fluid is water, water containing a density-increasing constituent, a fluid solution, a fluid suspension, a solvent fluid, a solubilizing fluid, or a shock-impedance-matching fluid.

14. The device of claim 1, further comprising an outer tamping container at least partially surrounding the container for containing fluid.

15. The device of claim 1, wherein the detonating means comprises a detonator selected from the group consisting of detonating cord, a blasting cap, a non-electric detonator, an instantaneous non-electric detonator, a short period delay non-electric detonator, a long period delay non-electric detonator, an instantaneous electric detonator, a short period delay electric detonator, a long period delay electric detonator, an exploding-bridgewire detonator, a slapper detonator, a pencil detonator, a stab initiator detonator, a hot wire initiator detonator, and a direct laser initiator of high explosive.

16. The device of claim 1, wherein fluid overlays the top side of the explosive to a depth approximately equal to or greater than a distance between the front side of the explosive and the bottom of the concavity and optionally wherein a top side of the container is open.

17. The device of claim 1, the container comprising a fluid port, a front section comprising the concavity, and a back section comprising a detonator well for operably connecting the detonating means to the explosive, the front section and the back section each comprising a mating means to form a liquid-tight seal when mated.

18. The device of claim 17, wherein the mating means comprises a flange with a flange facing selected from the group consisting of a flat face, a raised face, a ring joint, a male-and-female joint, and a tongue-and-groove joint.

19. The device of claim 17, wherein the explosive holder comprises a flange edge configured for engagement with the mating means of the front section and the back section and wherein the front section and the back section are in fluidic communication.

20. The device of claim 17, wherein the explosive holder comprises an explosive receiving cavity wherein at least one layer of plastic explosive is positioned.

21. A method for penetrating a wall using a device for generating a fluid jet, the method comprising:

loading the device of claim 1 with a blade-forming fluid;

positioning the device adjacent to a wall at a separation distance;

detonating an explosive within the device to generate a fluid blade and a secondarily impacting fluid body;

accelerating the fluid blade and secondarily impacting fluid body toward the wall using detonation gases;

penetrating the wall with the fluid blade to form a hole; and admitting the secondarily impacting fluid body through the hole.

22. The method of claim 21, wherein the separation distance is between approximately zero and a maximum standoff distance determined by a thickness and a material composition of the wall and an amount of explosive generating the fluid blade.

* * * * *